US011169476B2

(12) United States Patent
Igarashi et al.

(10) Patent No.: US 11,169,476 B2
(45) Date of Patent: Nov. 9, 2021

(54) SHEET MANAGEMENT SYSTEM, CONTROL METHOD, AND NON-TRANSITORY COMPUTER READABLE STORAGE MEDIUM

(71) Applicant: CANON KABUSHIKI KAISHA, Tokyo (JP)

(72) Inventors: Hiroya Igarashi, Toride (JP); Nobuhiro Kawamura, Nagareyama (JP); Yusuke Kimura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/509,176

(22) Filed: Jul. 11, 2019

(65) Prior Publication Data

US 2020/0033781 A1 Jan. 30, 2020

(30) Foreign Application Priority Data

Jul. 26, 2018 (JP) ..... JP2018-140394

(51) Int. Cl.
*G03G 15/00* (2006.01)

(52) U.S. Cl.
CPC ..... *G03G 15/502* (2013.01); *G03G 15/5029* (2013.01); *G03G 15/6561* (2013.01)

(58) Field of Classification Search
None
See application file for complete search history.

(56) References Cited

U.S. PATENT DOCUMENTS

2002/0143893 A1* 10/2002 Nakazono ..... G03G 21/1892 709/217
2015/0009533 A1* 1/2015 Anno ..... G06F 3/121 358/1.15
2017/0099570 A1* 4/2017 Yamada ..... H04W 4/80
2018/0173543 A1* 6/2018 Ukegawa ..... B41J 29/00
2018/0217789 A1* 8/2018 Tsuji ..... H04W 4/80

FOREIGN PATENT DOCUMENTS

JP 2018-81366 A 5/2018
JP 2018-86766 A 6/2018
JP 2018-109833 A 7/2018

* cited by examiner

*Primary Examiner* — Frantz Bataille
(74) *Attorney, Agent, or Firm* — Canon U.S.A., Inc. I.P. Division

(57) ABSTRACT

A sheet management system includes an image forming apparatus and first and second information processing apparatuses to communicate with the image forming apparatus. The first information processing apparatus includes a first LAN interface connected to the image forming apparatus, a second LAN interface connected to a network, and a first display to display information. To display a screen for performing sheet management on the first display, the first information processing apparatus obtains device information of the image forming apparatus based on information on an apparatus connected via the first LAN interface. The second information processing apparatus includes a third. LAN interface connected to the network and a second display to display information. To display a screen for performing sheet management on the second display, the second information processing apparatus obtains device information of the image forming apparatus via the third LAN interface using address information entered by a user.

21 Claims, 22 Drawing Sheets

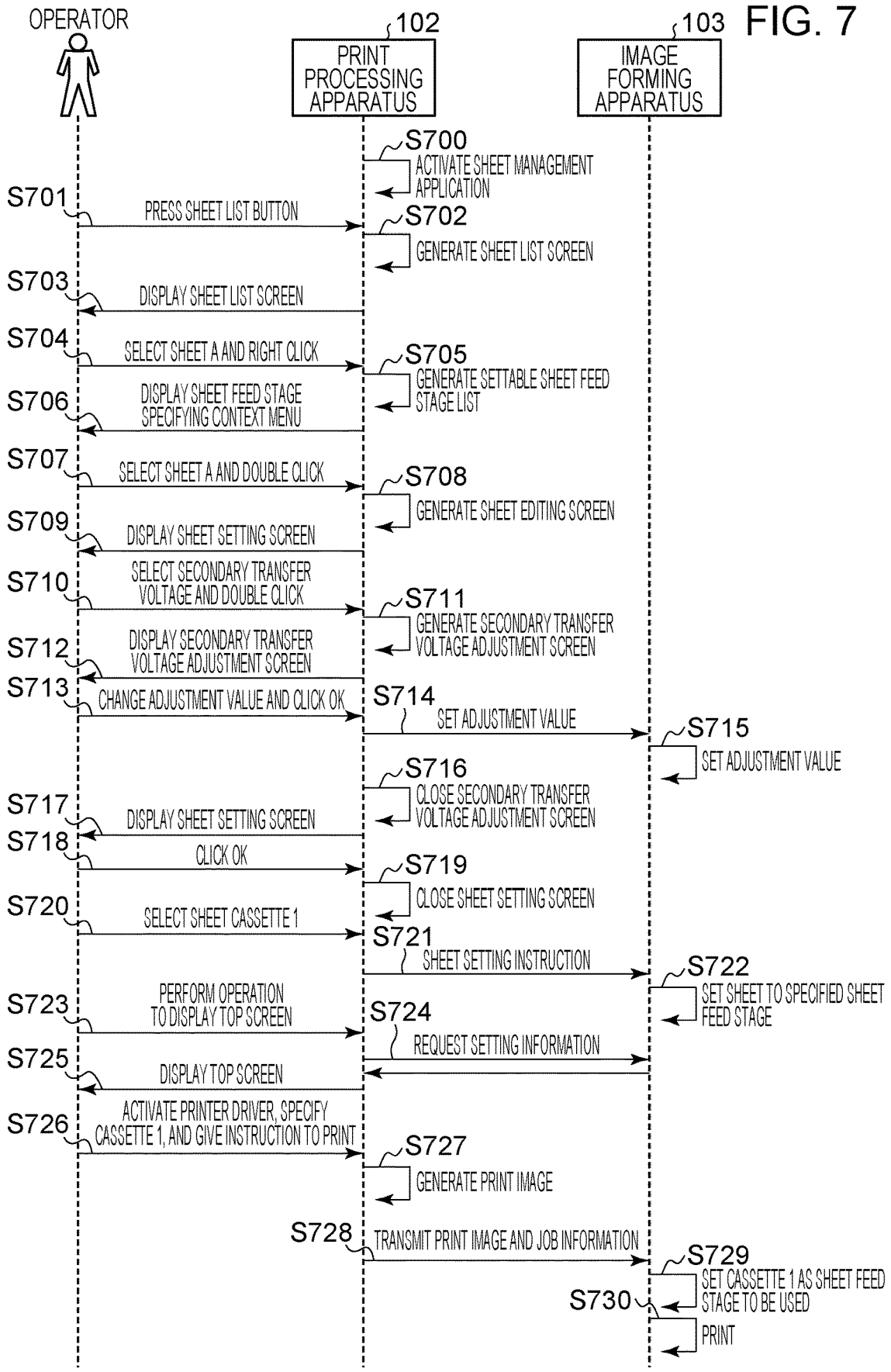
FIG. 7
OPERATOR
102
PRINT PROCESSING APPARATUS
103
IMAGE FORMING APPARATUS
S700
ACTIVATE SHEET MANAGEMENT APPLICATION
S701
PRESS SHEET LIST BUTTON
S702
GENERATE SHEET LIST SCREEN
S703
DISPLAY SHEET LIST SCREEN
S704
SELECT SHEET A AND RIGHT CLICK
S705
GENERATE SETTABLE SHEET FEED STAGE LIST
S706
DISPLAY SHEET FEED STAGE SPECIFYING CONTEXT MENU
S707
SELECT SHEET A AND DOUBLE CLICK
S708
GENERATE SHEET EDITING SCREEN
S709
DISPLAY SHEET SETTING SCREEN
S710
SELECT SECONDARY TRANSFER VOLTAGE AND DOUBLE CLICK
S711
GENERATE SECONDARY TRANSFER VOLTAGE ADJUSTMENT SCREEN
S712
DISPLAY SECONDARY TRANSFER VOLTAGE ADJUSTMENT SCREEN
S713
CHANGE ADJUSTMENT VALUE AND CLICK OK
S714
SET ADJUSTMENT VALUE
S715
SET ADJUSTMENT VALUE
S716
CLOSE SECONDARY TRANSFER VOLTAGE ADJUSTMENT SCREEN
S717
DISPLAY SHEET SETTING SCREEN
S718
CLICK OK
S719
CLOSE SHEET SETTING SCREEN
S720
SELECT SHEET CASSETTE 1
S721
SHEET SETTING INSTRUCTION
S722
SET SHEET TO SPECIFIED SHEET FEED STAGE
S723
PERFORM OPERATION TO DISPLAY TOP SCREEN
S724
REQUEST SETTING INFORMATION
S725
DISPLAY TOP SCREEN
S726
ACTIVATE PRINTER DRIVER, SPECIFY CASSETTE 1, AND GIVE INSTRUCTION TO PRINT
S727
GENERATE PRINT IMAGE
S728
TRANSMIT PRINT IMAGE AND JOB INFORMATION
S729
SET CASSETTE 1 AS SHEET FEED STAGE TO BE USED
S730
PRINT

SHEET MANAGEMENT SYSTEM, CONTROL METHOD, AND NON-TRANSITORY COMPUTER READABLE STORAGE MEDIUM

BACKGROUND

Field

The present disclosure relates to a print system for managing information on sheets used in printing. This print system includes an image forming apparatus such as a printer and a copy machine, and an information processing apparatus such a personal computer (PC).

Description of the Related Art

Hitherto, an image forming apparatus (print apparatus) such as a printer has been known as an apparatus for forming an image on a sheet. In addition, a print system in which information on sheets used in such a print apparatus is managed by another apparatus (information processing apparatus) has also been known (Japanese Patent Laid-Open No. 2018-86766).

Because the information processing apparatus in Japanese Patent Laid-Open No. 2018-86766 is configured to set adjustment values contributing to printing for each sheet type, advanced printing can be realized. In addition, sheet types for which adjustment values are set can be managed in linkage with sheet trays. For that reason, advanced printing can be used properly to meet various needs by linking various sheet types with different sheet trays. In particular, Japanese Patent Laid-Open No. 2018-86766 describes that the corresponding relationship between sheet trays and sheet types is displayed as a list on a screen. As such, the user can properly use advanced printing to meet various needs by giving instructions to execute printing while checking this screen.

Japanese Patent Laid-Open No. 2018-86766 describes that only an information processing apparatus directly connected to the image forming apparatus performs sheet management. However, in consideration of the user's convenience, sheet management should be performed with the same or similar operability even from other information processing apparatuses on a network. To realize this, for example, a sheet management application provided with a remote operation function may be distributed to a directly connected information processing apparatus and to other information processing apparatuses. By entering address information such as an Internet Protocol (IP) address on this sheet management application, sheet management can be performed even from any terminal on the network.

However, it may sometimes be bothersome to enter such address information for an apparatus whose sheet management destination can be specified in advance, such as an information processing apparatus directly connected to the image forming apparatus.

SUMMARY

Disclosed is a sheet management system to be compatible with a method of identifying a sheet management destination based on entry of address information, and a method of identifying a sheet management destination without entry of address information. In this regard, the present disclosure provides a sheet management system configured to provide operability in accordance with an information processing apparatus. In particular, the present disclosure provides a sheet management system including an information processing apparatus that identifies a sheet management destination based on entry of an IP address, and an information processing apparatus that identifies a sheet management destination without entry of an IP address.

According to an aspect of the present disclosure, a sheet management system includes an image forming apparatus configured to perform printing on a sheet, a first information processing apparatus configured to communicate with the image forming apparatus, and a second information processing apparatus configured to communicate with the image forming apparatus via the first information processing apparatus, wherein the first information processing apparatus includes: a first local area network (LAN) interface connected to the image forming apparatus, a second LAN interface connected to a network, a first display configured to display information, and a unit configured to obtain device information, wherein, to display a screen for performing sheet management on the first display, the unit of the first information processing apparatus obtains device information of the image forming apparatus based on information on an apparatus connected via the first LAN interface, and wherein the second information processing apparatus includes: a third LAN interface connected to the network, a second display configured to display information, and a unit configured to obtain device information, wherein, to display a screen for performing sheet management on the second display, the unit of the second information processing apparatus obtains device information of the image forming apparatus via the third LAN interface using address information entered by a user.

Further features of the present disclosure will become apparent from the following description of exemplary embodiments with reference to the attached drawings.

BRIEF DESCRIPTION OF THE DRAWINGS

FIG. 7 is a basic flowchart of sheet management.

DESCRIPTION OF THE EMBODIMENTS

Hereinafter, embodiments of the present disclosure will be described using the drawings. Here, the basic configuration of a sheet management system will be described first, and then a configuration corresponding to a use case will be described in detail in each embodiment.

Sheet Management System

Figure 1A:
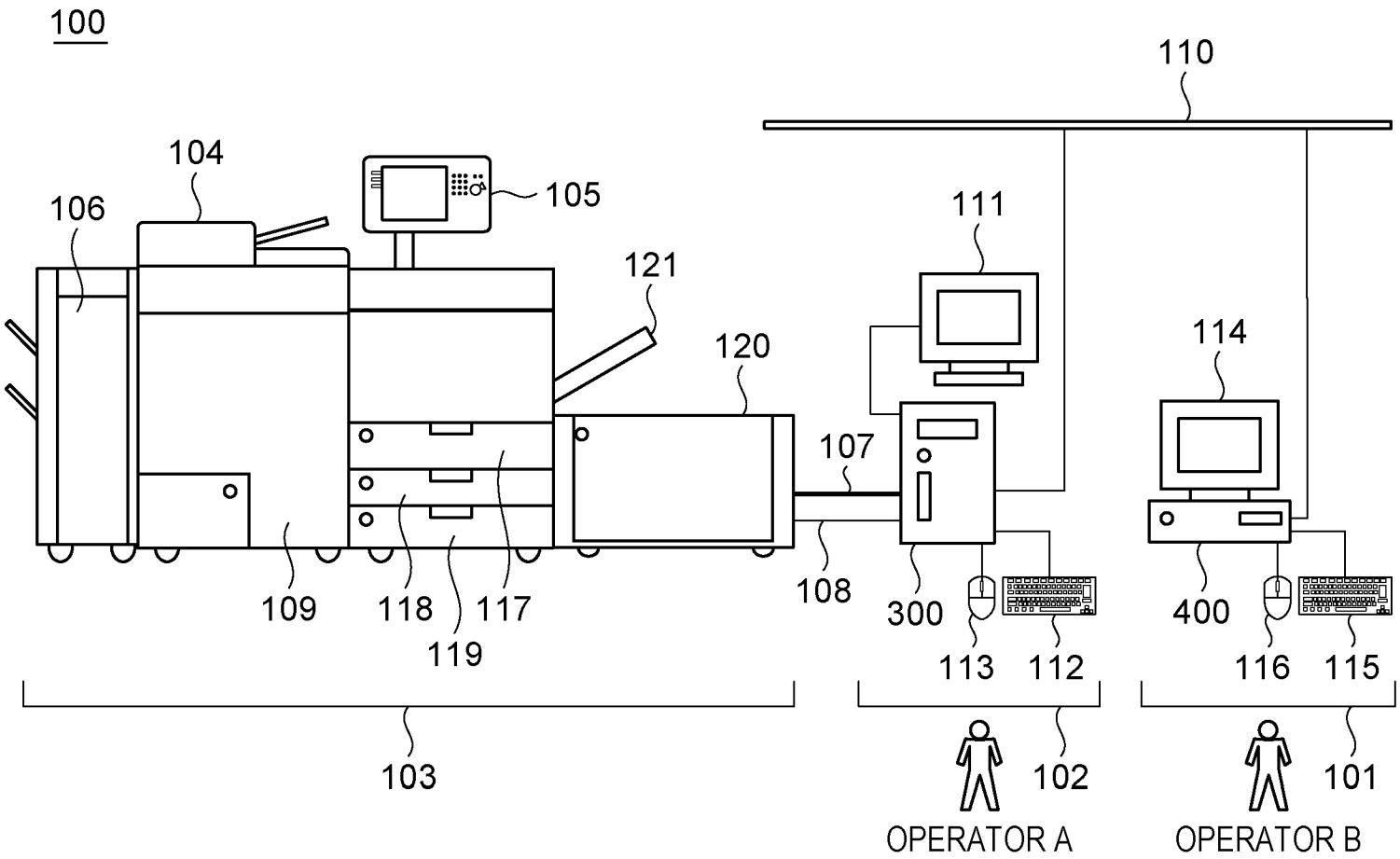
FIG. 1A is a diagram illustrating the configuration of a sheet management system.

The outline of the sheet management system will be described. FIG. 1A is a diagram illustrating the configuration of the sheet management system. A sheet management system (print system) 100 illustrated in FIG. 1A includes a client computer 101, a print processing apparatus 102, and an image forming apparatus 103, and these apparatuses are communicably connected to each other. The client computer 101 and the print processing apparatus 102 function as external terminals (information processing apparatuses) for the image forming apparatus 103.

The client computer 101 and the print processing apparatus 102 are communicably connected to each other via a local area network (LAN) 110. In addition, the print processing apparatus 102 and the image forming apparatus 103 are connected to each other via an image video cable 107 and a control cable 108. Note that the image forming apparatus 103 is not directly connected to the LAN 110. The image forming apparatus 103 and the client computer 101 communicate with each other via the print processing apparatus 102. Alternatively, the image forming apparatus 103 may be connected to the LAN 110. In other words, the image forming apparatus 103 may be directly and communicably connected to the client computer 101.

The image forming apparatus 103 is a multifunction peripheral (MFP) that has various functions. The image forming apparatus 103 executes printing based on data received from the client computer 101 or the print processing apparatus 102. In addition, the image forming apparatus 103 is configured to copy image data read from a document, and transmitting the image data to a shared folder.

The client computer 101 activates an application to operate the sheet management system 100, and gives a print instruction from a printer driver.

The print processing apparatus 102 activates an application to operate the sheet management system 100, and gives a print instruction from a printer driver. The print processing apparatus 102 has an image processing function in collaboration with the image forming apparatus 103. The print processing apparatus 102 functions as a reception on the LAN 110 for the image forming apparatus 103, and, on receipt of communication regarding image formation, transfers that to the image forming apparatus 103. For example, in the case of operating the image forming apparatus 103 from the client computer 101 using a sheet management application or a printer driver, the print processing apparatus 102 may be specified as a communication destination.

Figure 1B:
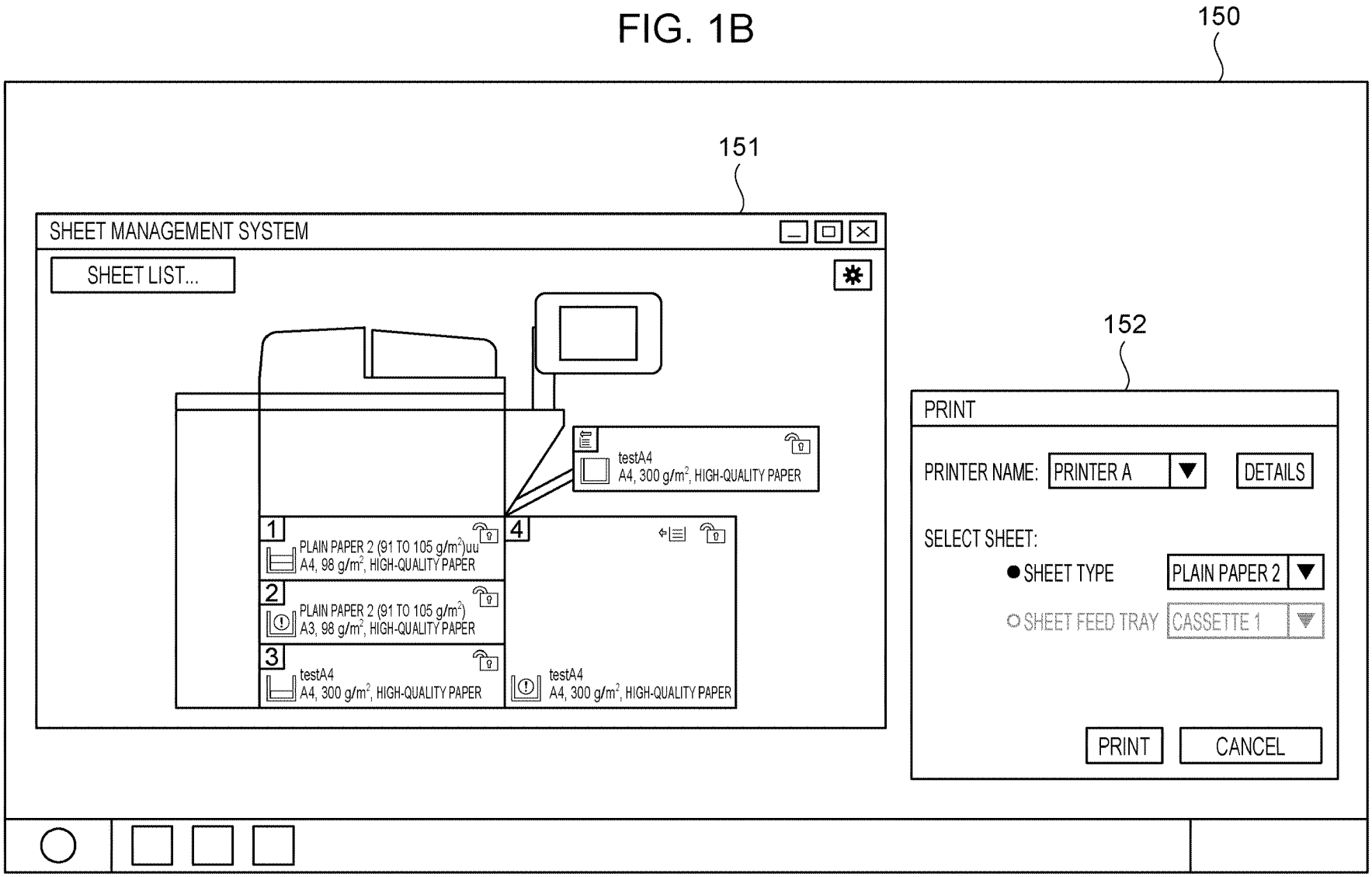
FIG. 1B is a diagram illustrating a sheet management screen.

The user displays a print management screen and performs print management on the client computer 101 and the print processing apparatus 102. FIG. 1B is a diagram illustrating the print management screen. A print management screen 150 includes a window for a sheet management application 151, and a window for a printer driver 152. The user manages sheet information using the sheet management application 151, and gives an instruction to execute a print job using the printer driver 152.

Image Forming Apparatus

Figure 2A:
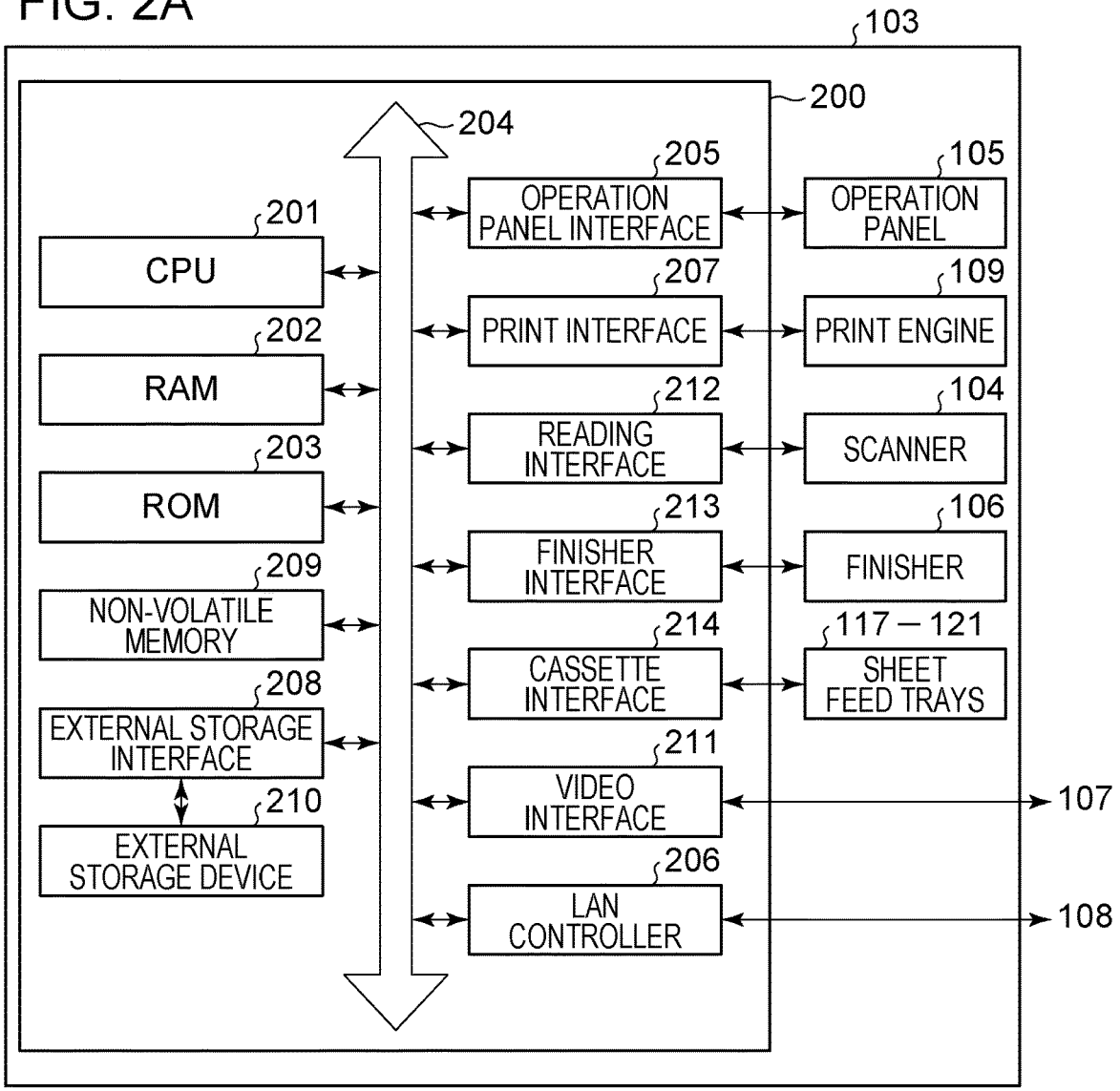
FIG. 2A is a diagram illustrating the hardware configuration of an image forming apparatus.

The configuration of the image forming apparatus will be described. FIG. 2A is a diagram illustrating the hardware configuration of the image forming apparatus 103.

As illustrated in FIG. 2A, the image forming apparatus 103 includes an operation panel 105, a print engine 109, a scanner 104, a finisher 106, sheet feed trays 117 to 121, and a controller 200.

The operation panel 105 is a panel that displays information to the user and accepts an operation performed by the user. The operation panel 105 includes a display such as a liquid crystal display (LCD) screen, and an input unit such as a touch sensor and hardware keys.

The print engine 109 is an image forming processor that forms an image on a sheet. The print engine 109 performs printing by forming an image using, for example, electrophotography, and thermally fixing a toner image on a sheet.

The scanner 104 is a reading device that reads a document. Reading of a document may be performed on a pressure platen or using an automatic document feeder (ADF).

The finisher 106 is a post-processing device that applies post processing to a sheet. The finisher 106 applies sorting, punching, stapling, and so forth to a sheet conveyed from the print engine 109, and discharges the sheet.

The sheet feed trays 117 to 121 are sheet storage sections that store sheets used in image formation. Each sheet feed tray is assigned a number, and information on stored sheets can be managed using the sheet management application.

The controller 200 is a control unit that comprehensively controls the image forming apparatus 103. The controller 200 includes a central processing unit (CPU) 201, random-access memory (RAM) 202, read-only memory (ROM) 203, non-volatile memory 209, an operation panel interface 205, a print interface 207, a reading interface 212, a finisher interface 213, a cassette interface 214, an external storage interface 208, a video interface 211, and a LAN controller 206.

The CPU 201 comprehensively controls access with various devices connected to a system bus 204 based on a control program stored in the ROM 203 or an external storage device 210. The RAM 202 mainly functions as main memory, a work area, and so forth of the CPU 201. The interfaces 205, 207, 212, 213, 208, and 214 allow input and output of data between a connected device and the CPU 201.

The external storage device 210 is a storage unit that stores data, and, for example, a hard disk drive (HDD) or the like is used. The external storage device 210 is used to store application programs, font data, form data, and so forth. The external storage device 210 is used as a job storage area for temporarily spooling a print job and controlling the spooled job from the outside. The external storage device 210 holds image data read from the scanner 104 and image data in a print job as held print data. The external storage device 210 holds various logs such as job logs and image logs. The non-volatile memory 209 stores various types of setting information. The video interface 211 receives image data transmitted from the print processing apparatus 102 via the cable 107. The LAN controller 206 (LAN interface) communicates with the print processing apparatus 102 via the cable 108 and receives control commands and so forth.

Figure 2B:
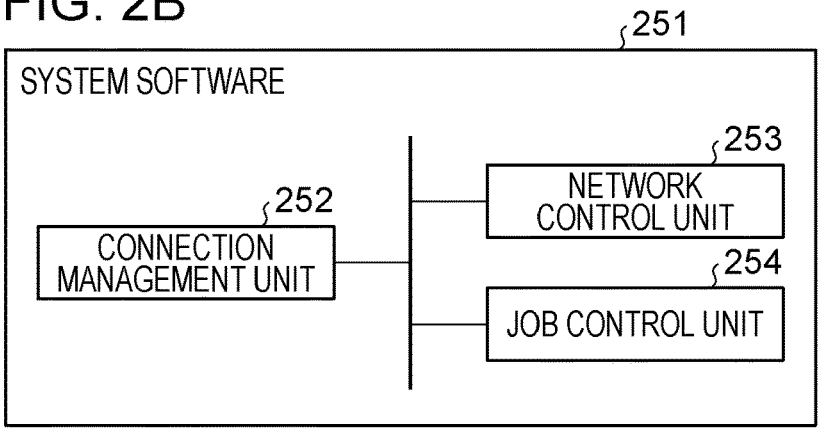
FIG. 2B is a diagram illustrating the software configuration of the image forming apparatus.

FIG. 2B is a diagram illustrating the software configuration of the image forming apparatus 103. System software 251 for controlling the image forming apparatus 103 includes a connection management unit 252, a network control unit 253, and a job control unit 254. The system software 251 is realized by executing a program by the CPU 201 in the controller 200. In other words, the controller 200 functions as various units in the system software 251.

The connection management unit 252 is a unit that controls connection management between an application on the client computer 101 or the print processing apparatus 102 and the image forming apparatus 103. The connection management unit 252 is configured to manage the number of connections of applications being connected, and exchanging that with the client computer 101 or the print processing apparatus 102. Connection source information is managed as illustrated in, for example, FIGS. 15A and 15B. The network control unit 253 is a unit that controls communication processing with the print processing apparatus 102 via the LAN controller 206. The job control unit 254 is a unit that controls printing such as a print processing sequence and the order of jobs. The job control unit 254 causes the print engine 109 to execute printing based on image data transmitted from the print processing apparatus 102.

Print Processing Apparatus

Figure 3A:
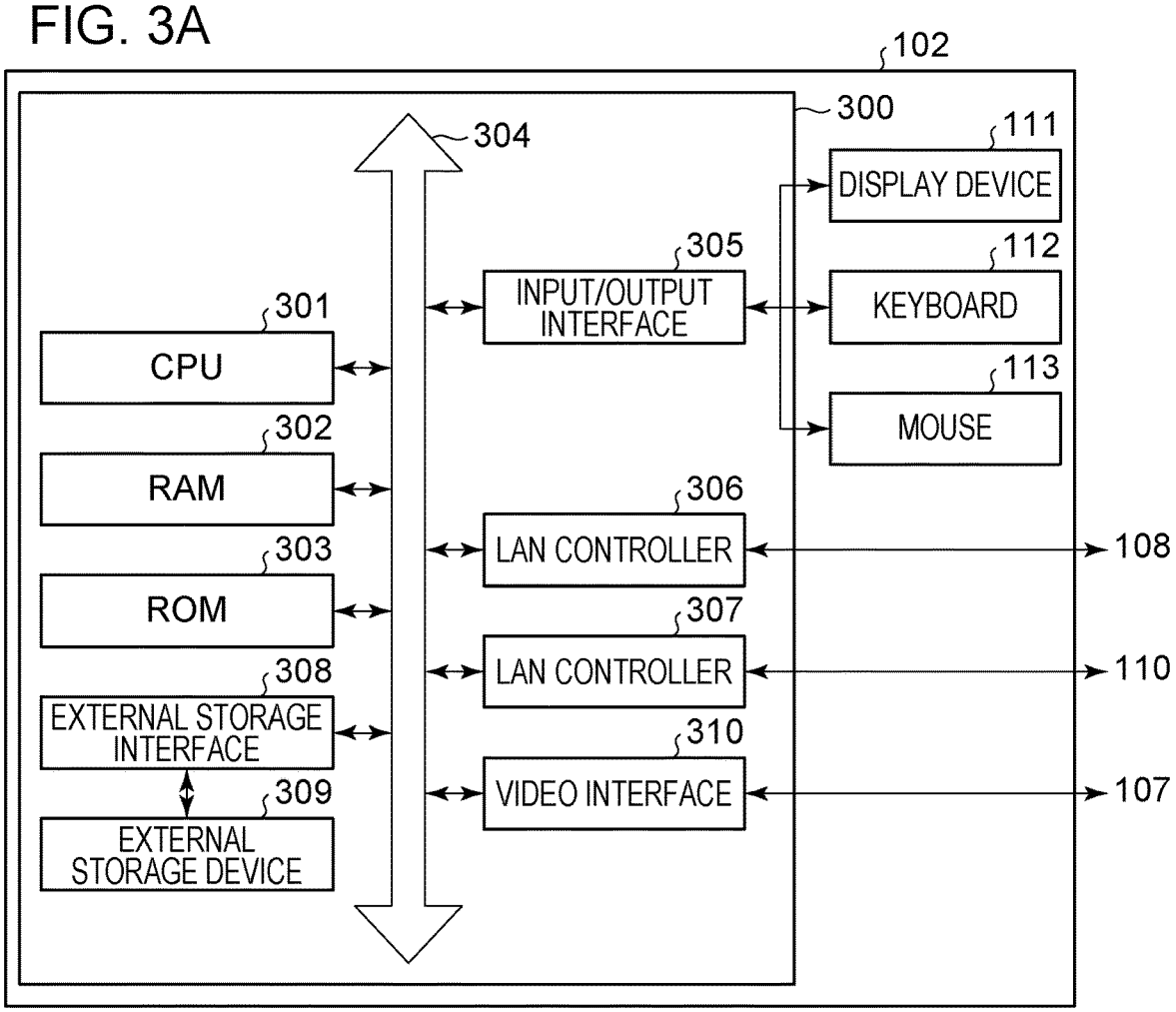
FIG. 3A is a diagram illustrating the hardware configuration of a print processing apparatus.

The configuration of the print processing apparatus will be described. FIG. 3A is a diagram illustrating the hardware configuration of the print processing apparatus 102.

As illustrated in FIG. 3A, the print processing apparatus 102 includes a display device 111, a keyboard 112, a mouse 113, and a controller 300.

The display device 111 is a display that displays information, and, for example, is a liquid crystal monitor. The display device 111 may be a touchscreen.

The keyboard 112 and the mouse 113 are input units that accept input operations performed by the user.

The controller 300 is a control unit that comprehensively controls the print processing apparatus 102. The control 300 includes a CPU 301, RAM 302, ROM 303, an input/output interface 305, an external storage interface 308, LAN controllers 306 and 307, and a video interface 310.

The CPU 301 comprehensively controls access with various devices connected to a system bus 304 based on a control program stored in the ROM 303 or an external storage device 309. The RAM 302 mainly functions as main memory, a work area, and so forth of the CPU 301. The interfaces 305 and 308 allow input and output of data between a connected device and the CPU 301. The external storage device 309 stores application programs, font data, form data, and so forth, and temporarily spools a print job. The external storage device 309 is used as a job storage area for applying raster image processing (RIP) to the spooled job, and again saving the job.

The LAN controller 306 communicates with the image forming apparatus 103 via the cable 108 and transmits control commands and so forth. The LAN controller 307 connects to a network via the cable 110. The video interface 310 transmits the RIP-processed image data to the image forming apparatus 103 via the cable 107.

Figure 3B:
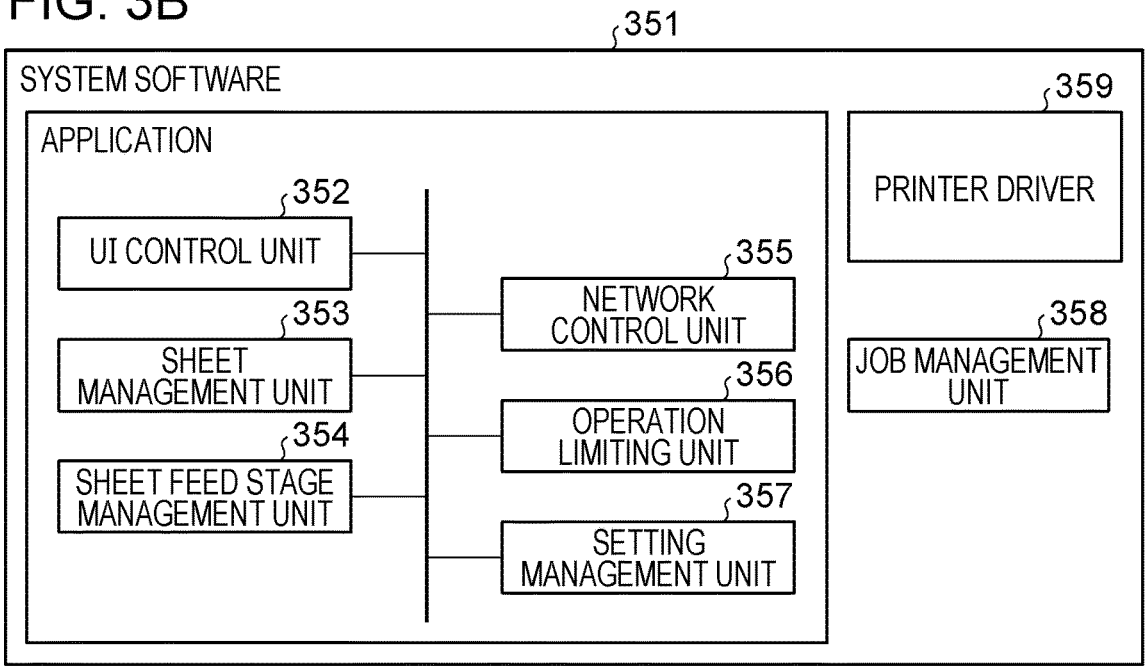
FIG. 3B is a diagram illustrating the software configuration of the print processing apparatus.

FIG. 3B illustrates the software configuration of the print processing apparatus 102.

System software 351 for controlling the print processing apparatus 102 includes an application for performing sheet management operation, a printer driver 359 for giving print instructions, and a job management unit 358.

The application for performing sheet management operation includes a user interface (UI) control unit 352, a sheet management unit 353, a sheet feed stage management unit 354, a network control unit 355, an operation limiting unit 356, and a setting management unit 357.

The UI control unit 352 is a unit that controls a screen displayed in the sheet management system. The UI control unit 352 is configured to apply control to switch text displayed on the screen or display of the sheet size display unit system in accordance with the system settings.

The sheet management unit 353 is a unit that communicates with the image forming apparatus 103 and manages obtained sheet information. Sheet information is managed as, for example, a sheet setting management table (not illustrated). The sheet management unit 353 is configured to execute editing, adding, deleting, and searching for sheet information in the sheet setting management table. The sheet setting management table is a management table for managing sheet information for each sheet ID, and is managed by the external storage device 309, which is a non-volatile area.

The sheet feed stage management unit 354 is a unit that communicates with the image forming apparatus 103 and manages obtained sheet feed stage information. Sheet feed stage information is managed as, for example, a sheet feed stage management table (not illustrated). The sheet feed stage management unit 354 is configured to execute editing, adding, deleting, and searching for sheet feed stage information in the sheet feed stage management table. The sheet feed stage management table is a management table for managing sheet feed stage information for each sheet feed stage ID, and is managed by the external storage device 309, which is a non-volatile area.

The network control unit 355 is a unit that controls communication processing with the image forming apparatus 103 via the LAN controller 306, and with the client computer 101 on a network via the LAN controller 307. The network control unit 355 controls communication processing for transmitting and receiving operation instructions for the sheet management system 100 from the client computer 101, which are received via the LAN controller 307, to and from the image forming apparatus 103 via the LAN controller 306.

The operation limiting unit 356 is a unit that controls multiple connections. An operation limiting table (not illustrated) is stored in the external storage device 309, which is a nonvolatile area.

The setting management unit 357 is a unit that managers system settings regarding the sheet management system, and favorite information. The setting management unit 357 is configured to execute editing, adding, deleting, and searching for favorite information. The system settings are, for example, language settings of text displayed on the screen in the sheet management system, and settings of the sheet size display unit system (mm or cm). A setting management table is a management table for managing setting information of the sheet management system 100. The setting management table is stored in the external storage device 309, which is a non-volatile area.

The job management unit 358 is a unit that managers the print processing sequence and the order of jobs. The job management unit 358 manages a job received by the print processing apparatus 102, and controls data transfer for printing the received job to the image forming apparatus 103 via the LAN controller 306 and the video interface 310. In addition, the job management unit 358 transfers data transmitted from the network to a specific port of the LAN controller 307 to the image forming apparatus 103. Similarly, the job management unit 358 transfers data transmitted from the image forming apparatus 103 to a specific port of the LAN controller 306 to a specified destination on the network.

Client Computer

Figure 4A:
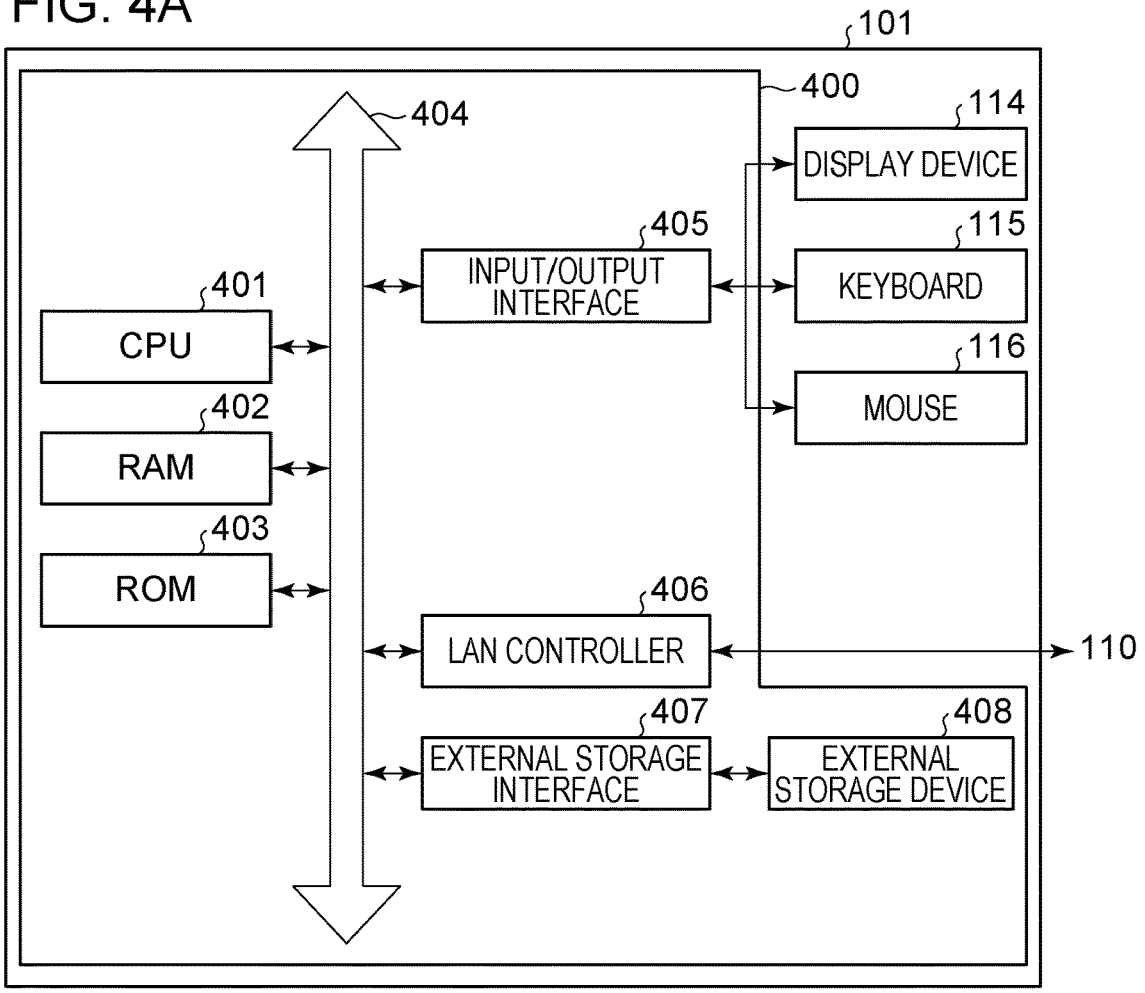
FIG. 4A is a diagram illustrating the hardware configuration of a client computer.

The configuration of the client computer 101 will be described. FIG. 4A is a diagram illustrating the hardware configuration of the client computer 101. As illustrated in FIG. 4A, the client computer 101 includes a display device 114, a keyboard 115, a mouse 116, and a controller 400.

The display device 114 is a display that displays information, and, for example, is a liquid crystal monitor. The display device 114 may be a touchscreen.

The keyboard 115 and the mouse 116 are input units that accept input operations performed by the user.

The controller 400 is a control unit that comprehensively controls the client computer 101. The controller 400 includes a CPU 401, RAM 402, ROM 403, an input/output interface 405, an external storage interface 407, and a LAN controller 406.

The CPU 401 comprehensively controls access with various devices connected to a system bus 404 based on a control program stored in the ROM 403 or an external storage device 408. The RAM 402 mainly functions as main memory, a work area, and so forth of the CPU 401. The interfaces 405 and 407 allow input and output of data between a connected device and the CPU 401. Although a plurality of devices is connected to the interface 405, interfaces may be separately arranged in accordance with the number of connected devices. The external storage device 408 stores application programs, font data, form data, and so forth.

Figure 4B:
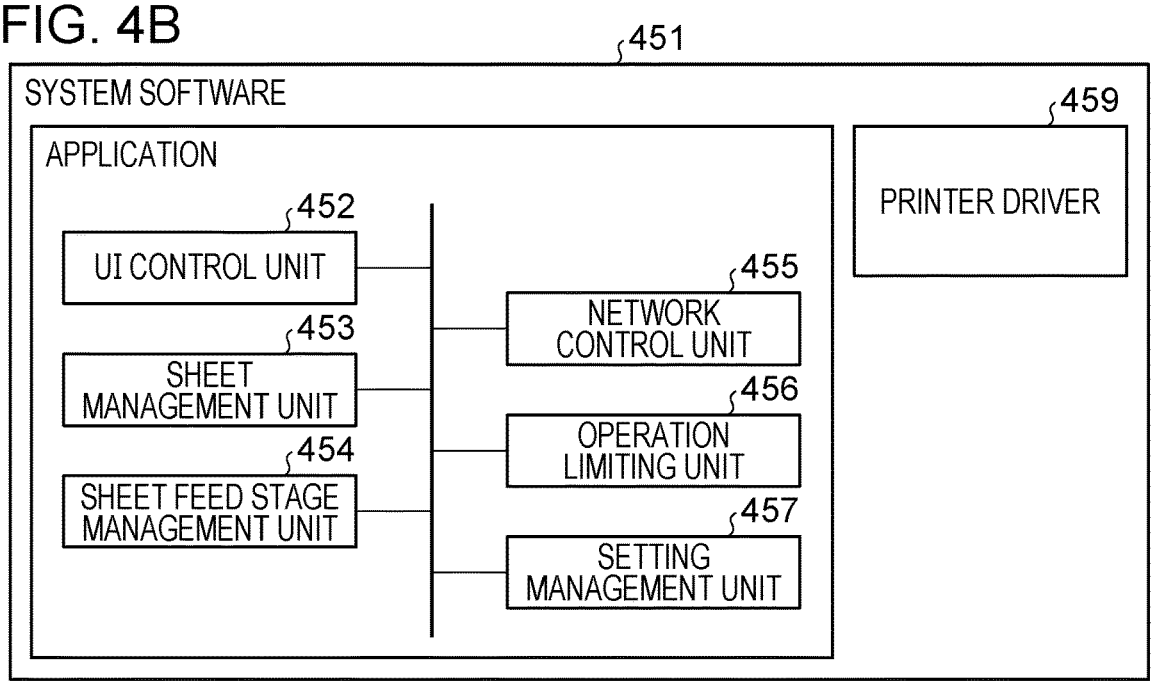
FIG. 4B is a diagram illustrating the software configuration of the client computer.

FIG. 4B is a diagram illustrating the software configuration of the client computer 101. System software 451 for controlling the client computer 101 includes an application for performing sheet management operation, and a printer driver 459 for giving print instructions.

The application for performing sheet management operation includes a UI control unit 452, a sheet management unit 453, a sheet feed stage management unit 454, a network control unit 455, an operation limiting unit 456, and a setting management unit 457. Since these units are the same as those units with the corresponding names in FIG. 3B, descriptions thereof will be omitted.

Operation Flow from Sheet Setting to Printing

The flow of a process performed by an operator to change the sheet settings and to perform printing will be described using FIG. 7.

In S700, the print processing apparatus 102 activates the sheet management application.

In S701, the operator presses a sheet list button 811 on a top screen 810 of the sheet management application.

In S702, the controller 300 controls the UI control unit 352 to obtain the sheet setting management table (not illustrated) from the sheet management unit 353. The controller 300 controls the U1 control unit 352 to generate a sheet list screen 830 in accordance with the obtained sheet list In S703, the controller 300 causes the UI control unit 352 to display the sheet list screen 830 on the display device 111.

In S704, the operator selects a sheet to be used in printing by left clicking on that sheet on the sheet list screen 830. The controller 300 controls the UI control unit 352 such that the sheet selected with the left click will be in a selected state. The operator right clicks the name area in order to register the sheet to a sheet feed stage.

In S705, in response to detection of the right click, the controller 300 controls the UI control unit 352 to generate a sheet registration context menu. The controller 300 applies control to obtain from the sheet management unit 353 one or more settable sheet feed stage IDs in the sheet setting management table (not illustrated) that correspond(s) to the sheet, and to obtain one or more corresponding sheet feed stage names from the sheet feed stage management table (not illustrated). For example, the controller 300 obtains the settable sheet feed stage IDs={1, 2, 3, 4, and 5} for sheet A (sheet ID=1), and obtains the sheet feed stage names of these sheet feed stage IDs from the sheet feed stage management table. In this example, sheet cassette 1, sheet cassette 2, sheet cassette 3, sheet cassette 4, and manual teed tray are obtained, and the controller 300 generates a sheet registration context menu for the UI control unit 352.

In S706, the controller 300 controls the UI control unit 352 to display the sheet registration context menu.

In S707, the operator selects a sheet to be used in printing on the sheet list screen 830, and double clicks on that sheet.

In S708, the controller 300 controls the UI control unit 352 to generate a sheet setting screen 850.

In S709, the controller 300 controls the UI control unit 352 to display the sheet setting screen 850.

In S710, the operator double clicks on adjustment of secondary transfer voltage on a sheet information adjustment item list 852 on the sheet setting screen 850.

In S711, the controller 300 controls the U1 control unit 352 to generate a secondary transfer voltage adjustment screen (not illustrated).

In S712, the controller 300 controls the UI control unit 352 to display the secondary transfer voltage adjustment screen (not illustrated).

In S713, the operator changes the adjustment value on the secondary transfer voltage adjustment screen (not illustrated), and clicks an OK button 892.

In S714, the controller 300 controls the sheet management unit 353 to set the adjustment value to the image forming apparatus 103.

In S715, the controller 200 applies control to set the received adjustment value.

In S716, the controller 300 controls the UI control unit 352 to close the secondary transfer voltage adjustment screen (not illustrated).

In S717, the controller 300 controls the UI control unit 352 to display the sheet setting screen 850.

In S718, the operator clicks an OK button 854 on the sheet setting screen 850, and ends the sheet setting change.

In S719, the controller 300 controls the UI control unit 352 to close the sheet setting screen 850.

In S720, on the sheet list screen 830, the operator selects a sheet to be used in printing, selects sheet cassette 1 from the sheet registration context menu described in S705, and registers the sheet to the sheet feed stage.

In S721, the controller 300 controls the sheet management unit 353 to generate a sheet setting instruction in order to register, in sheet cassette 1, information in the sheet setting management table corresponding to the sheet being selected. The controller 300 controls the LAN controller 306 using the network control unit 355 to transmit the sheet setting instruction to the image forming apparatus 103 via the control cable 108.

In S722, on receipt of the sheet setting instruction by the LAN controller 206, the controller 200 sets sheet information of the received sheet to the specified sheet feed stage (sheet cassette 1 here). The controller 300 counts up the use log of the sheet for which the sheet setting has been done, and applies control to write the use log to the sheet setting management table.

The above is the description of the process of setting a sheet used in printing. Note that the process of storing a to-be-set sheet to a corresponding sheet feed stage may be performed at any time point.

Next, the flow of printing company A job 1 using the set sheet will be described.

In the case of inputting a print job, the operator gives an instruction to display the top screen in order to list the corresponding relationship between sheet feed stages and sheets (S723). On receipt of the top screen display instruction, the print processing apparatus 102 obtains the latest sheet setting information from the image forming apparatus 103 (S724). Then, the print processing apparatus 102 presents the top screen based on the obtained latest information to the operator (S725).

Having checked the top screen, the operator activates the print application or the printer driver in order to give a print instruction (S726). The print application or the printer driver specifies the type of sheet used in printing, the sheet feed stage, and so forth. When the print instruction is given, the printer driver outputs page description language (PDL) data. The output data is managed by the job management unit 358. The controller 300 performs RIP processing based on the obtained PDL data, and generates raster image data or the like that is readable by the image forming apparatus 103 (S727). The controller 300 analyzes the print instruction included in the PDL data, and generates print adjustment information used in printing.

In S728, the controller 300 transmits the image data and the print adjustment information used in printing as print data to the image forming apparatus 103. Here, sheet cassette 1 is specified in the print data as the sheet feed stage. The controller 300 controls the LAN controller 306 using the network control unit 355. The controller 300 transmits the print adjustment information to the image forming apparatus 103 via the control cable 108. In addition, the controller 300 controls the video interface 310 using the job management unit 358 to transmit the image data to the image forming apparatus 103 via the image video cable 107.

In S729, the controller 200 confirms the sheet feed stage for feeding a sheet in accordance with the received print data. Here, because sheet cassette 1 has been specified in the print data as the sheet feed stage, sheet cassette 1 is used.

In S730, the controller 200 outputs an image signal to the print engine 109 connected via the print interface 207. In this manner, the print engine 109 receives the image signal and executes printing.

The above is the description of the flow of a process from changing the setting to printing. Description of the following embodiments assumes an environment where the flow of such a process is performed.

Sheet Management Application

As described above, the sheet management application is executed on the print processing apparatus 102 or the client computer 101. The sheet management application provides screen information for prompting the operator to perform operation. More specifically, the CPU 301, which executes the sheet management application, renders an image in the RAM 302, and the image data rendered in the RAM 302 is output as a video signal to the display device 111, thereby displaying a screen.

Top Screen

Figure 8A:
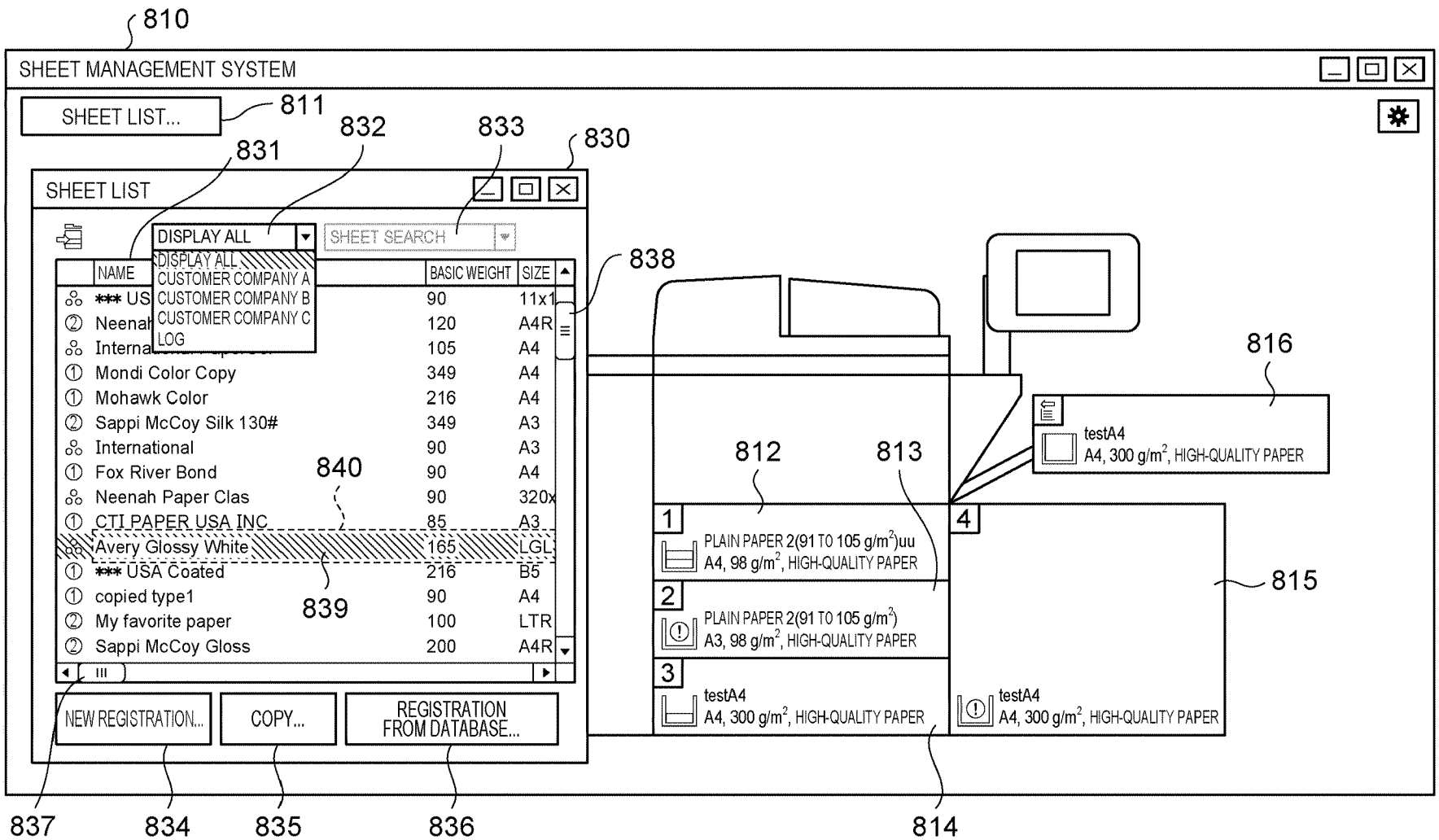
FIG. 8A is a diagram illustrating a sheet list screen.

The top screen of the sheet management application will be described. FIG. 8A is a diagram illustrating a sheet list screen.

A top screen 810 is a screen in a state where information on sheet feed stages of the image forming apparatus 103 is displayed. The top screen 810 represents the connection status of a hardware option of the image forming apparatus 103 connected to the print processing apparatus 102. Upon activation, the sheet management application obtains hardware option information of the image forming apparatus 103, and displays the correct image in accordance with this option information.

The sheet list button 811 is a button for giving an instruction to display a sheet list screen. In the present embodiment, when the button 811 is pressed, the controller 300 displays the sheet list screen 830 illustrated in FIG. 8A, and displays the sheet list screen 830 on top.

Sheet feed stage buttons 812 to 816 are arranged based on information on sheet feed stages of the image forming apparatus 103 obtained upon activation of the sheet management application. In FIG. 8A, a state in which five sheet feed stages (one of them is manual feed tray) are connected is indicated. On receipt of a sheet feed stage state change event from the image forming apparatus 103 upon the occurrence of a change of the state of a sheet feed stage(s) of the image forming apparatus 103, the controller 300 again obtains the sheet feed stage information. When the button 812 of sheet feed stage 1 is pressed using the mouse 113 or the like, the sheet setting screen of sheet feed stage 1 is displayed.

Sheet List Screen

The sheet list screen will be described. FIG. 8A is a diagram illustrating the sheet list screen.

The sheet list screen 830 is a screen that displays a list of sheets, which allows generation, copying, deletion, and setting changes of sheets, and an operation of registering a selected sheet to a sheet feed stage.

Regarding the sheet list screen 830, image data is rendered in the RAM 302 in accordance with an instruction from the CPU 301, the image data rendered in the RAM 302 is output as a video signal to the display device 111, and the image data is displayed on the display device 111. On the sheet list screen 830, a sheet list 831, a pull-down menu 832 for selecting the method of displaying a sheet list, a sheet search entry area 833, and buttons to add sheets to the sheet list are displayed. As the buttons to add sheets, a new registration button 834 for registering a new sheet on the sheet list, a copy button 835 for copying an existing sheet on the sheet list, and a registration button 836 for generating a sheet from a sheet database are displayed.

The sheet list 831 is a table for displaying a sheet list. Sheet information is set in the row, and sheets are set in the column. Information outside the display range of a display area becomes displayable by operating a slider bar 837 and a slider bar 838. A sheet being selected is highlighted to indicate that it is selected. When any unselected sheet is selected from the table of the sheet list 831, information on the sheet being selected is displayed in the sheet list display area 831.

A pull-down menu for selecting the method of displaying a sheet list will be described. The pull-down menu 832 displays display devices of the sheet list display area 831, which is an option for filtering the display contents of the sheet list display area 831.

The search entry area 833 will be described. The search entry area 833 is an area for the operator to enter a keyword for searching for a desired or predetermined sheet from sheets on the sheet list 831.

Right click on a row 839 where a favorite icon is displayed causes a favorite registration menu to be displayed, thereby allowing setting of a favorite sheet. Right click on other rows 840 causes a sheet registration context menu to be displayed, thereby allowing selection of a registrable sheet feed stage and setting of a sheet being selected. In addition, pressing a deletion key while a sheet is being selected allows deletion of the selected sheet from the sheet list.

Sheet Setting Screen

Figure 8B:
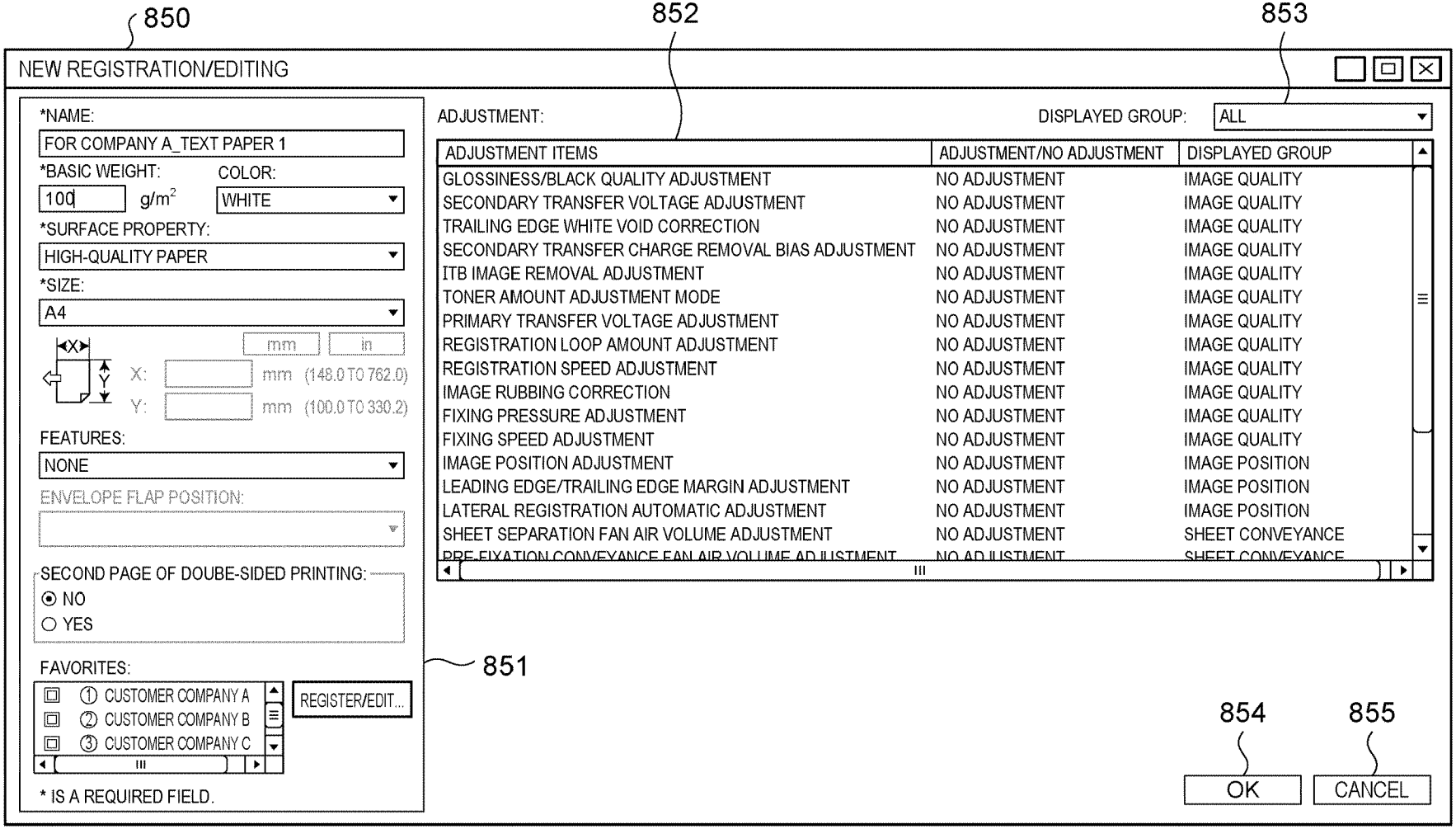
FIG. 8B is a diagram illustrating a sheet setting screen.

A sheet setting screen will be described. FIG. 8B is a diagram illustrating a sheet setting screen. The sheet setting screen 850 illustrated in FIG. 8B will be described. The sheet setting screen 850 is a screen for newly registering a sheet and editing a registered sheet. The sheet setting screen 850 includes basic entry items 851, the sheet information adjustment item list 852, a pull-down menu 853 for switching a displayed group of the adjustment item list, the OK button 854, and a cancel button 855. The basic entry items 851 are minimum setting items in sheet information for handling sheets. In the present embodiment, for example, name, basic weight, color, surface property, size, features, second page of double-sided printing, and favorites are displayed as the setting items. To reflect the changed information in the sheet information, the OK button 854 on the sheet setting screen 850 is pressed. Pressing the OK button 854 allows change of the sheet information in the print processing apparatus 102 and the image forming apparatus 103. Pressing the cancel button 855 allows cancellation of the sheet setting.

The adjustment item list 852 includes setting values included in sheet information (associated with a sheet). For the adjustable (updatable) items, a list including name, adjusted/not adjusted, and displayed group is displayed. Note that the adjustment of an adjustment item may be such that selecting the adjustment item list 852 may allow display of a detailed value of the adjustment value and an adjustment button on the sheet setting screen 850, and pressing the adjustment button may allow display of a target adjustment screen. Adjustment items displayed on the adjustment item list 852 will be briefly described. Adjustment of glossiness/black quality is an item for adjusting the glossiness of an output image by adjusting the temperature of a fixing unit when using plain paper or coated paper. As for the displayed group, this is defined as image quality. Adjustment of secondary transfer voltage is an adjustment item for changing the voltage when transferring a toner image to a sheet. As for the displayed group, this is defined as image quality. The trailing edge white void correction is an adjustment item for changing a transfer voltage in the case where toner void occurs or the color of the toner becomes lighter at the trailing edge of a sheet with respect to the conveying direction. As for the displayed group, this is defined as image quality. The secondary transfer charge removal bias adjustment is an adjustment item for changing the voltage value (charge removal bias) for removing static electricity remaining on an intermediate transfer belt. As for the displayed group, this is defined as image quality. The ITB image removal adjustment is an adjustment item for changing the degree of image removal on the intermediate transfer belt. As for the displayed group, this is defined as image quality. The toner amount adjustment mode is an adjustment item for changing the total amount of toner. As for the displayed group, this is defined as image quality. Adjustment of primary transfer voltage is an adjustment item for changing the voltage when transferring a toner image from the intermediate transfer belt to a sheet. As for the displayed group, this is defined as image quality. Adjustment of registration loop amount is an adjustment item for changing the amount of flexure of a sheet that is formed when adjusting the image position. As for the displayed group, this is defined as image quality Adjustment of the registration speed is an adjustment item for changing the speed when adjusting the image position. As for the displayed group, this is defined as image quality. Adjustment of image rubbing correction is an adjustment item for changing the conveying speed when the image is distorted or the density unevenness occurs because of the occurrence of a conveyance failure caused by sheet deformation due to uneven water content. As for the displayed group, this is defined as image quality. Adjustment of the fixing pressure is an adjustment item for changing the fixing pressure. As for the displayed group, this is defined as image quality. Adjustment of the fixing speed is an adjustment item for changing the fixing speed. As for the displayed group, this is defined as image quality.

Image position adjustment is an adjustment item for changing the printing position on the front and back sides of a sheet. As for the displayed group, this is defined as image position. The leading edge/trailing edge margin adjustment is an adjustment item for changing the length of the leading edge and the trailing edge with respect to the conveying direction at the time of printing. As for the displayed group, this is defined as image position. Automatic adjustment of lateral registration is an item for performing adjustment such that the image will not be shifted perpendicularly (laterally) with respect to the conveying direction. As for the displayed group, this is defined as image position. Air volume adjustment of a sheet separation fan is an adjustment item for changing the air volume of the fan when separating sheets. As for the displayed group, this is defined as sheet conveyance. Air volume adjustment of a pre-fixation conveying fan is an adjustment item for changing the air volume of the pre-fixation conveying fan. As for the displayed group, this is defined as sheet conveyance.

The pull-down menu 853 is a pull-down menu for allowing a filter to be selected to filer-display the adjustment item list 852 for each group. For example, when image quality is selected in the pull-down menu 853, the controller 300 controls the UT control unit 352 to display only the adjustment items whose displayed group is image quality in the adjustment item list 852.

Sheet Management Application Activation Process

Figure 5:
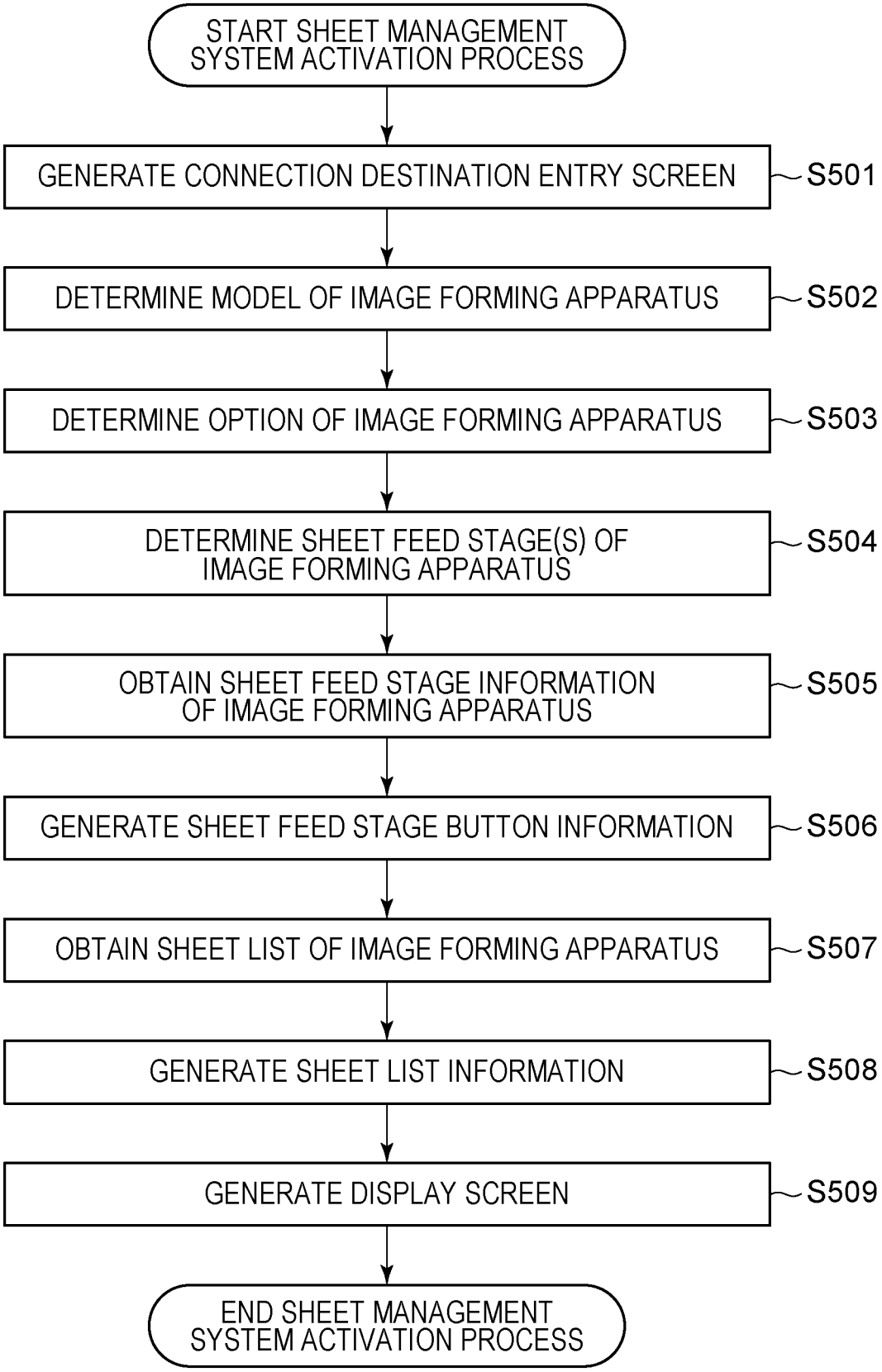
FIG. 5 is a flowchart illustrating a sheet management application activation process.

A process executed in response to activation of the sheet management application will be described. FIG. 5 is a flowchart of a sheet management application activation process.

A program of the sheet management application is stored in the external storage device 309, is read out to the RAM 302, and is executed by the CPU 301. In response to activation of the sheet management application, in S501 (hereinafter, step will be similarly abbreviated as "S"), the controller 300 generates a connection destination entry screen 1101 (FIG. 11) for entering a connection destination.

On the connection destination entry screen 1101, the IP address or host name of a connection destination apparatus can be entered. In the case of managing sheets for the image forming apparatus 103, the print processing apparatus 102 is relayed. Therefore, in the case of managing sheets for the image forming apparatus 103 from the client computer 101, the IP address of the print processing apparatus 102 is entered on the connection destination entry screen 1101. Similarly, in the case of managing sheets for the image forming apparatus 103 from the print processing apparatus 102, the IP address of the print processing apparatus 102 is entered.

In response to entry of the connection destination, the controller 300 connects to the print processing apparatus 102 specified by the entered IP address. The image forming apparatus 103 is notified of the IP address of the print processing apparatus 102, and the IP address is registered in the image forming apparatus 103. In the case of managing sheets by the client computer 101, the image forming apparatus 103 is notified of the IP address of the client computer 101, and the IP address is registered in the image forming apparatus 103. When the connection is established, the controller 300 advances the process to S502.

In S502, the controller 300 determines the model of the image forming apparatus 103 which serves as a target of sheet management. The controller 300 communicates with the image forming apparatus 103, and obtains model information. based on model determination information held in advance by the sheet management application, the controller 300 determines the model of the image forming apparatus 103, and obtains the basic configuration information of the image forming apparatus 103. When the model is determined in S502, the controller 300 advances the process to S503.

In S503, the controller 300 determines a hardware option connected to the image forming apparatus 103. The model determination information is used at the time of generating the top screen 810, at the time of specifying information on a sheet feed stage, or in absorbing specification differences between models. When the controller 300 communicates with the image forming apparatus 103 and obtains hardware option information, the controller 300 advances the process to S504.

In S504, the controller 300 determines one or more sheet feed stages connected to the image forming apparatus 103 which serves as a target of sheet management. The controller 300 obtains the number of connected sheet feed stages and sheet feed stage information. For example, the sheet feed stage information obtained here includes the sheet feed stage name, the sheet feed stage ID, and the amount of sheets remaining in the sheet feed stage. When one or more sheet feed stages are determined in S504, the controller 300 controls the sheet feed stage management unit 354 to write the obtained sheet feed stage information into a sheet feed stage management table (not illustrated). The controller 300 advances the process to S505.

In S505, the controller 300 communicates with the image forming apparatus 103, and obtains sheet information set to each sheet feed stage. When the controller 300 obtains sheet information (sheet ID) of each sheet feed stage in S505, the controller 300 controls the sheet feed stage management unit 354. The controller 300 writes the obtained sheet ID into an area that matches the target sheet feed stage ID of the sheet feed stage management table (not illustrated), and advances the process to S506.

In S506, the controller 300 generates information on the sheet feed stage buttons 812 to 816 to be displayed on the top screen 810. The sheet feed stage button 812 corresponds to a sheet feed tray 117. The sheet feed stage button 813 corresponds to a sheet feed tray 118. The sheet feed stage button 814 corresponds to a sheet feed tray 119. The sheet feed stage button 815 corresponds to a sheet feed tray 120. The sheet feed stage button 816 corresponds to a sheet feed tray 121. When the controller 300 generates information on the sheet feed stage buttons 812 to 816 in S506, the controller 300 advances the process to S507.

In S507, the controller 300 communicates with the image forming apparatus 103 and obtains sheet list information. The sheet list information includes information such as the sheet names, parameters for printing, favorite IDs, use logs, and settable sheet feed stage IDs. The parameters for printing include, for example, the basic weight and size of sheets displayed on the print processing apparatus 102, and the set values of adjustment items such as glossiness/black quality adjustment displayed on the adjustment item list 852. When the controller 300 obtains the sheet list information in S507, the controller 300 controls the sheet management unit 353 to write the obtained sheet information into a sheet setting management table (not illustrated), and the controller 300 advances the process to S508.

In S508, the controller 300 generates sheet list information to be displayed on the sheet list 831 on the sheet list screen 830. When the controller 300 generates the sheet list information in S508, the controller 300 advances the process to S509.

In S509, the controller 300 generates the top screen 810 from the model information and the hardware option information of the image forming apparatus 103 obtained in S502 and S503, and the sheet feed stage information generated in S506. The controller 300 generates the sheet list screen 830 from the sheet list information generated in S508.

Note that the item "sheet feed stage ID" settable to a sheet is an item to be updated in accordance with the to-be-connected image forming apparatus. A sheet feed stage ID settable to a sheet is derived and input based on sheet information and the configuration information of the image forming apparatus. Derivation of a sheet feed stage ID settable to a sheet may be performed by the print processing apparatus 102 or the image forming apparatus 103.

In addition, a use log is information that represents the number of times a sheet is registered. A use log is set as 0 times at the time a sheet is generated, and is counted up each time the sheet is registered in a sheet feed stage.

File Configuration

Figure 10A:
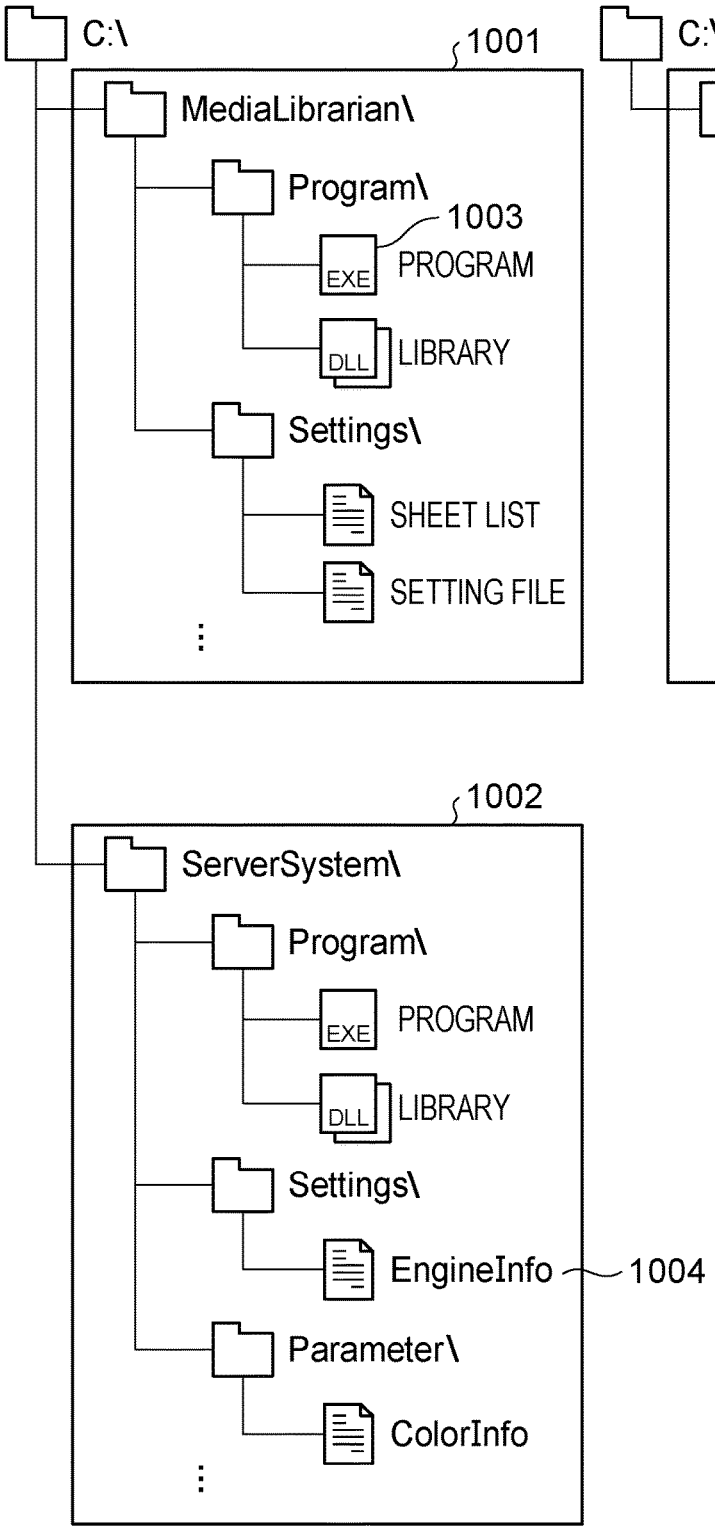
FIG. 10A is a diagram illustrating the directory configuration of the print processing apparatus.
Figure 10B:
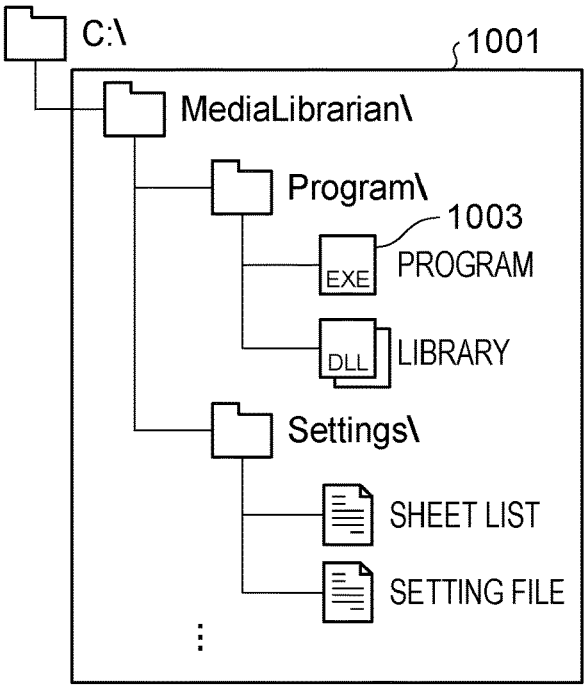
FIG. 10B is a diagram illustrating the directory configuration of the information processing apparatus.

The file configuration of the sheet management application will be described. FIG. 10A is a diagram illustrating the directory configuration of the print processing apparatus. FIG. 10B is a diagram illustrating the directory configuration of the information processing apparatus.

As illustrated in FIG. 10A, the print processing apparatus 102 includes a sheet management application folder 1001 and a server system folder 1002. In contrast, as illustrated in FIG. 10B, the client computer 101 includes the sheet management application folder 1001, but does not include the server system folder 1002.

The sheet management application folder 1001 is a directory area where an execution file 1003 regarding the sheet management application, and various setting files are stored.

The server system folder 1002 is a directory area where a group of files unique to the print processing apparatus 102 directly connected to the image forming apparatus 103 is stored.

Being provided with the server system folder 1002, the print processing apparatus 102 can use a port forwarding function. The port forwarding function is a function of transferring a packet arriving at a particular port to another apparatus. For example, in the case where the sheet management application on the client computer 101 gains access using the IP address of the print processing apparatus 102, a packet arrives at a certain port (a port for the sheet management application) of the LAN controller 307 of the print processing apparatus 102. Having received the packet, the print processing apparatus 102 transfers the packet to the image forming apparatus 103 based on information in the server system folder 1002. In addition, when a reply packet from the image forming apparatus 103 arrives at the LAN controller 306, this packet is transferred to the client computer 101. In this manner, data can be transmitted and received between the client computer 101 and the image forming apparatus 103. Accordingly, even in the case where the sheet management application is activated on the client computer 101, like the case where the sheet management application is activated on the print processing apparatus 102, device information of the image forming apparatus 103 can be obtained.

To execute the above-described port forwarding, the server system folder 1002 holds a device information file 1004. The device information file 1004 is a file in which a packet's transfer destination, that is, information on the image forming apparatus 103 directly connected to the print processing apparatus 102, is described. The device information file 1004 includes the IP address information of the image forming apparatus 103.

Response Process of Image Forming Apparatus

Figure 6:
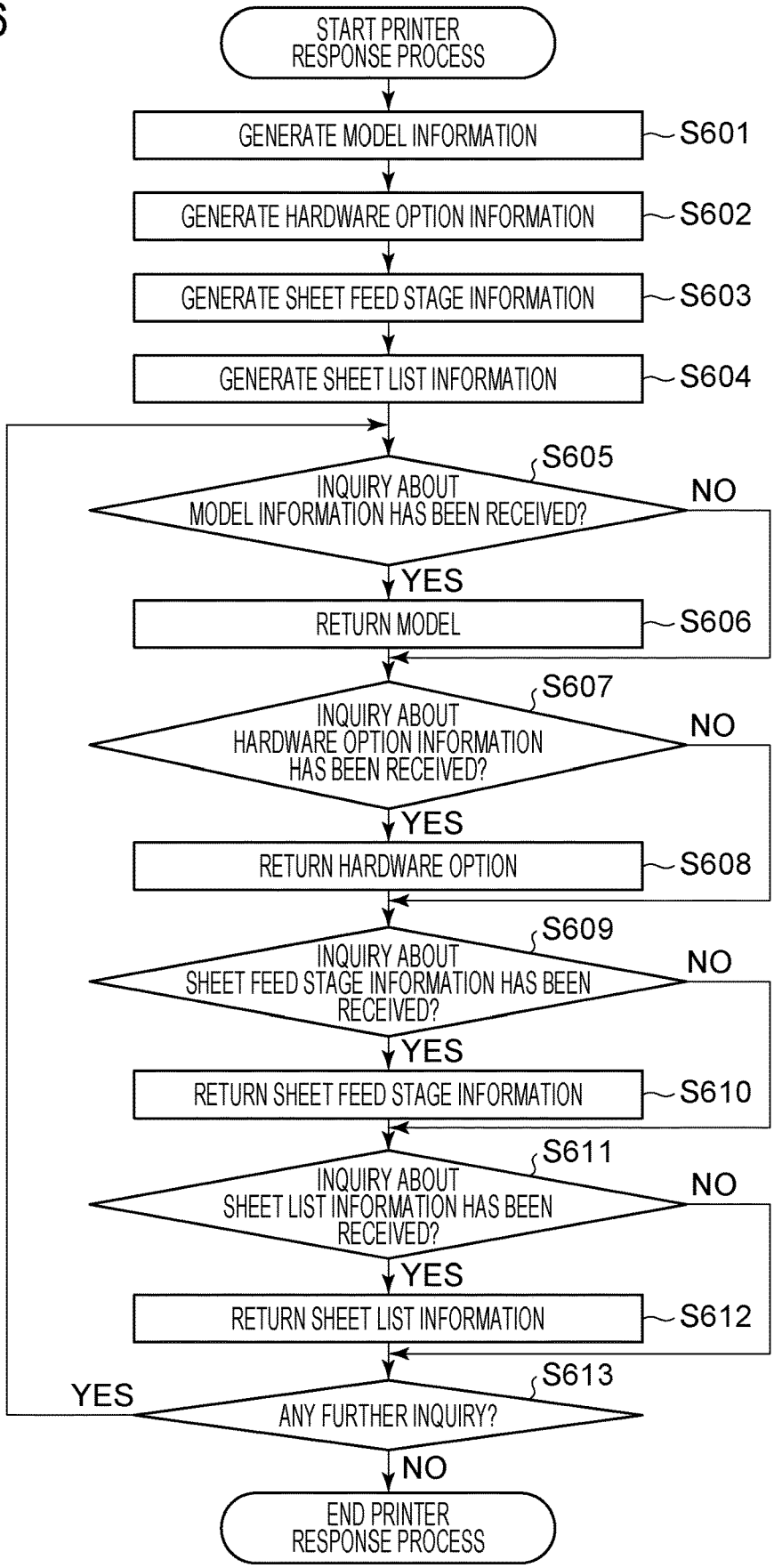
FIG. 6 is a flowchart illustrating a printer response process.

A process executed by the image forming apparatus 103 in response to the sheet management application activation process will be described. FIG. 6 is a flowchart of a response process of the image forming apparatus. A program for the image forming apparatus 103 according to the flowchart illustrated in FIG. 6 is stored in the external storage device 210 illustrated in FIG. 2, is read out to the RAM 202, and is executed by the CPU 201.

In S601, the controller 200 obtains model information of the image forming apparatus 103 from the external storage device 210, and stores the model information in the RAM 202 in a data format that can be transferred to another apparatus.

In S602, the controller 200 obtains hardware option information to which the image forming apparatus 103 is connected from the print engine 109 via the print interface 207. The controller 200 stores the hardware option information in the RAM 202 in a data format that can be transferred to another apparatus.

In S603, the controller 200 obtains sheet feed stage information of the image forming apparatus 103, and stores the sheet feed stage information in the RAM 202 in a data format that can be transferred to another apparatus.

In S604, the controller 200 obtains sheet list information of the image forming apparatus 103 from the external storage device 210, and stores the sheet list information in the RAM 202 in a data format that can be transferred to another apparatus.

In S605, the controller 200 determines whether or not an inquiry about model information has been received from the print processing apparatus 102. In the case where an inquiry about model information has been received, the controller 200 advances the process to S606, returns the model information generated in S601, and advances the process to S607. In the case where an inquiry about model information has not been received in S605, the controller 200 advances the process to S607.

In S607, the controller 200 determines whether or not an inquiry about hardware option information has been received from the print processing apparatus 102. In the case where an inquiry about hardware option information has been received, the controller 200 advances the process to S608, and returns the hardware option information generated in S602.

In S609, the controller 200 determines whether or not an inquiry about sheet feed stage information has been received from the print processing apparatus 102. In the case where an inquiry about sheet feed stage information has been received, the controller 200 advances the process to S610, and returns the sheet feed stage information generated in S603.

In S611, the controller 200 determines whether or not an inquiry about sheet list information has been received from the print processing apparatus 102. In the case where an inquiry about sheet list information has been received, the controller 200 advances the process to S612, and returns the sheet list information generated in S604.

Thereafter, in the case where there is a further inquiry, the process return to S605; and, in the case where there is no further inquiry; the process ends (S613).

First Embodiment

In a first embodiment, a sheet management system in which entry of the IP address is required in the case where the sheet management application is executed on the client computer 101, but entry of the IP address is not required in the case where the sheet management application is executed on the print processing apparatus 102 will be described. In particular in the present embodiment, the sheet management application determines the type of apparatus in which the sheet management application is installed, and provides UI according to the type.

Use Case

Figure 16A:
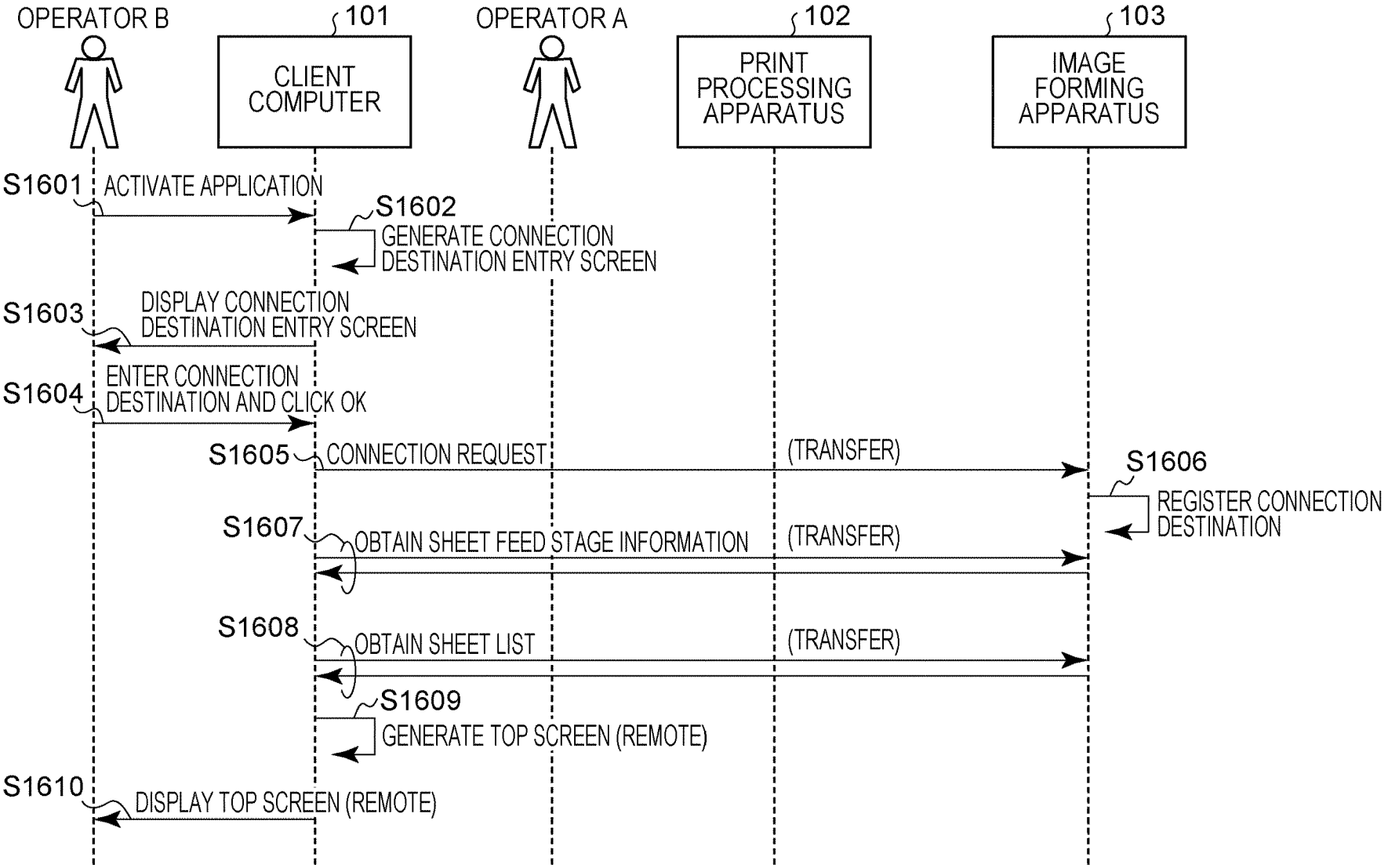
FIG. 16A is a diagram illustrating a use case of remote connection in the first embodiment.
Figure 16B:
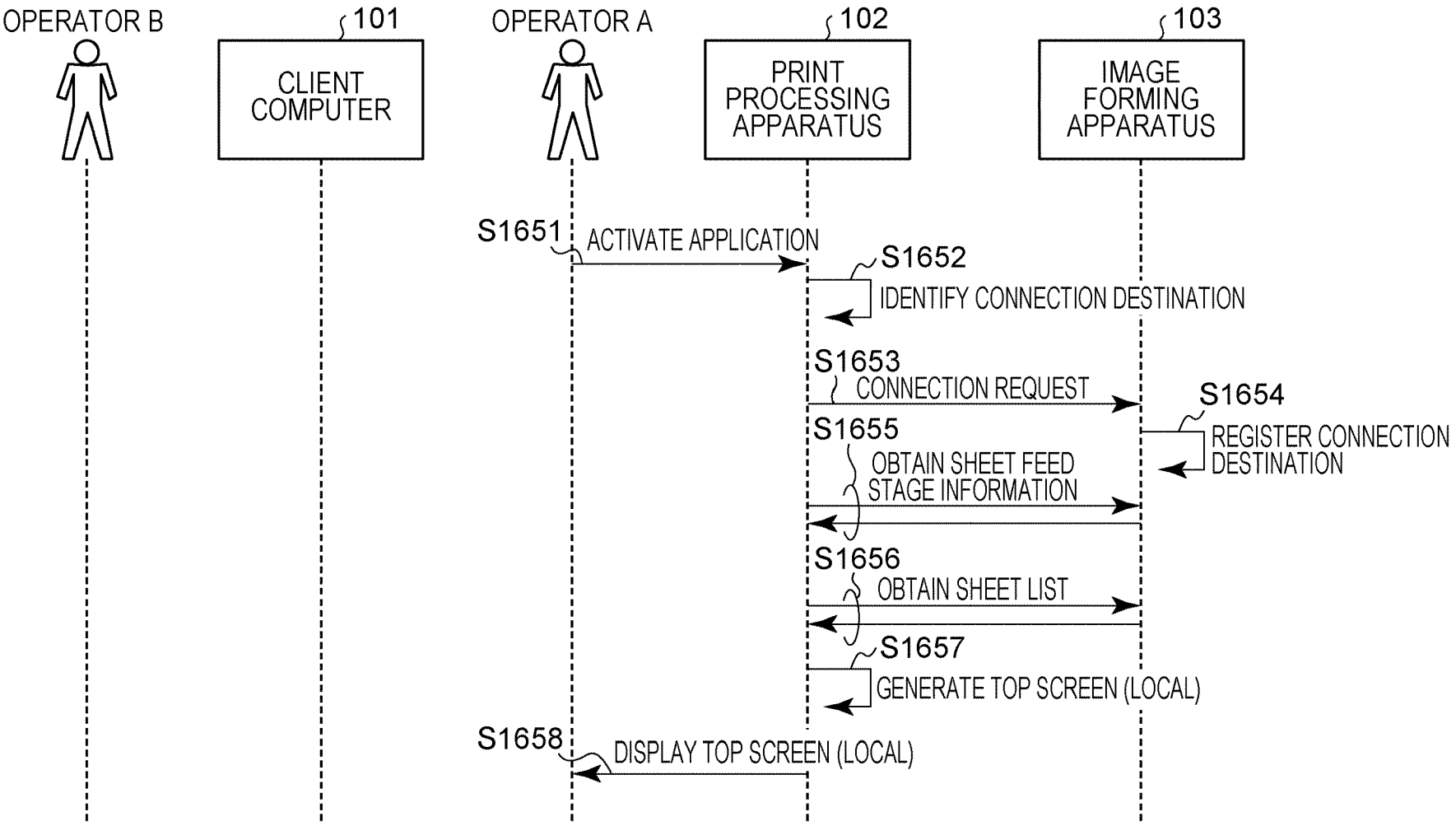
FIG. 16B is a diagram illustrating a use case of local connection in the first embodiment.

The flow of a process when executing the sheet management application will be described. At first, the case in which the sheet management application is used on the client computer 101 will be described. FIG. 16A is a diagram illustrating a use case of remote connection in the first embodiment.

In S1601, in order to start sheet management, operator B gives an instruction to activate the sheet management application. On receipt of the activation instruction, the client computer 101 generates a connection destination try screen (S1602), and displays the screen to prompt the user to enter the connection destination IP address (S1603). Having checked the connection destination entry screen, operator B enters and confirms a desired or predetermined connection destination (S1604). In the case of performing sheet management for the image forming apparatus 103, the IP address of the print processing apparatus 102 is entered. In order to connect to the image forming apparatus 103, the client computer 101 transmits a connection request to the print processing apparatus 102 (S1605). The print processing apparatus 102 transfers the details of this communication to the image forming apparatus 103. The connection request includes the IP address information of the client computer 101. On receipt of the connection request, the image forming apparatus 103 registers the IP address of the connection request source, and completes the connection procedure (S1606). In this manner, the client computer 101 and the image forming apparatus 103 are connected via the print processing apparatus 102.

When the connection procedure is completed, the client computer 101 obtains sheet feed stage information, sheet list information, and the like from the image forming apparatus 103 (S1607 and S1608). Having received these items of information, the client computer 101 generates a top screen (for remote operation) of the sheet management application based on the obtained information (S1609), and presents the top screen to operator B (S1610). In this manner, operator B uses the sheet management application which has become available for sheet management before giving a print instruction.

Next, the case in which the sheet management application is used on the print processing apparatus 102 will be described.

In S1651, in order to start sheet management, operator A gives an instruction to activate the sheet management application. On receipt of the activation instruction, the print processing apparatus 102 identifies the image forming apparatus 103 at the sheet management destination without displaying a connection destination entry screen (S1652). The print processing apparatus 102 transmits a connection request to the image forming apparatus 103 in order to connect to the image forming apparatus 103 (S1653). The connection request includes the IP address information of the print processing apparatus 102. On receipt of the connection request, the image forming apparatus 103 registers the IP address of the connection request source, and completes the connection procedure (S1654). In this manner, the print processing apparatus 102 and the image forming apparatus 103 are connected. When the connection procedure is completed, the print processing apparatus 102 obtains sheet feed stage information, sheet list information, and the like from the image forming apparatus 103 (S1655 and S1656). Having received these items of information, the print processing apparatus 102 generates a top screen (for local operation) of the sheet management application based on the obtained information (S1657), and presents the top screen to operator A (S1658). Operator A uses the sheet management application which has become available in this manner for sheet management before giving a print instruction.

Connection Destination Entry Screen

Figure 11:
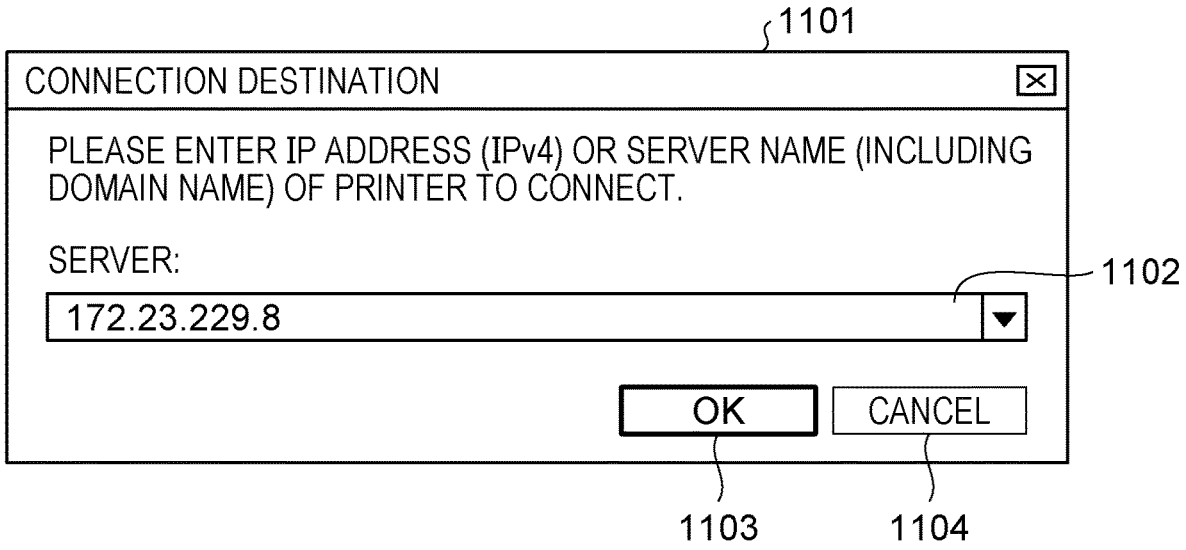
FIG. 11 is a diagram illustrating a connection destination entry screen.

The connection destination entry screen 1101 will be described. FIG. 11 is a diagram illustrating a connection destination entry screen. A connection destination entry screen is a screen for specifying an image forming apparatus to be managed by the sheet management application. The connection destination entry screen 1101 includes a connection destination information entry area 1102, an OK button 1103, and a cancel button 1104.

The connection destination information entry area 1102 is an area to enter the IP address or host name of the print processing apparatus 102 serving as a connection destination using the keyboard 112 or 115 and the mouse 113 or 116. The OK button 1103 is a button for connecting to the image forming apparatus 103 in accordance with the connection destination information entered in the connection destination information entry area 1102 and performing the activation process illustrated in FIG. 5. The cancel button 1104 is a button for ending the application.

Top Screen Distinction

Figure 12A:
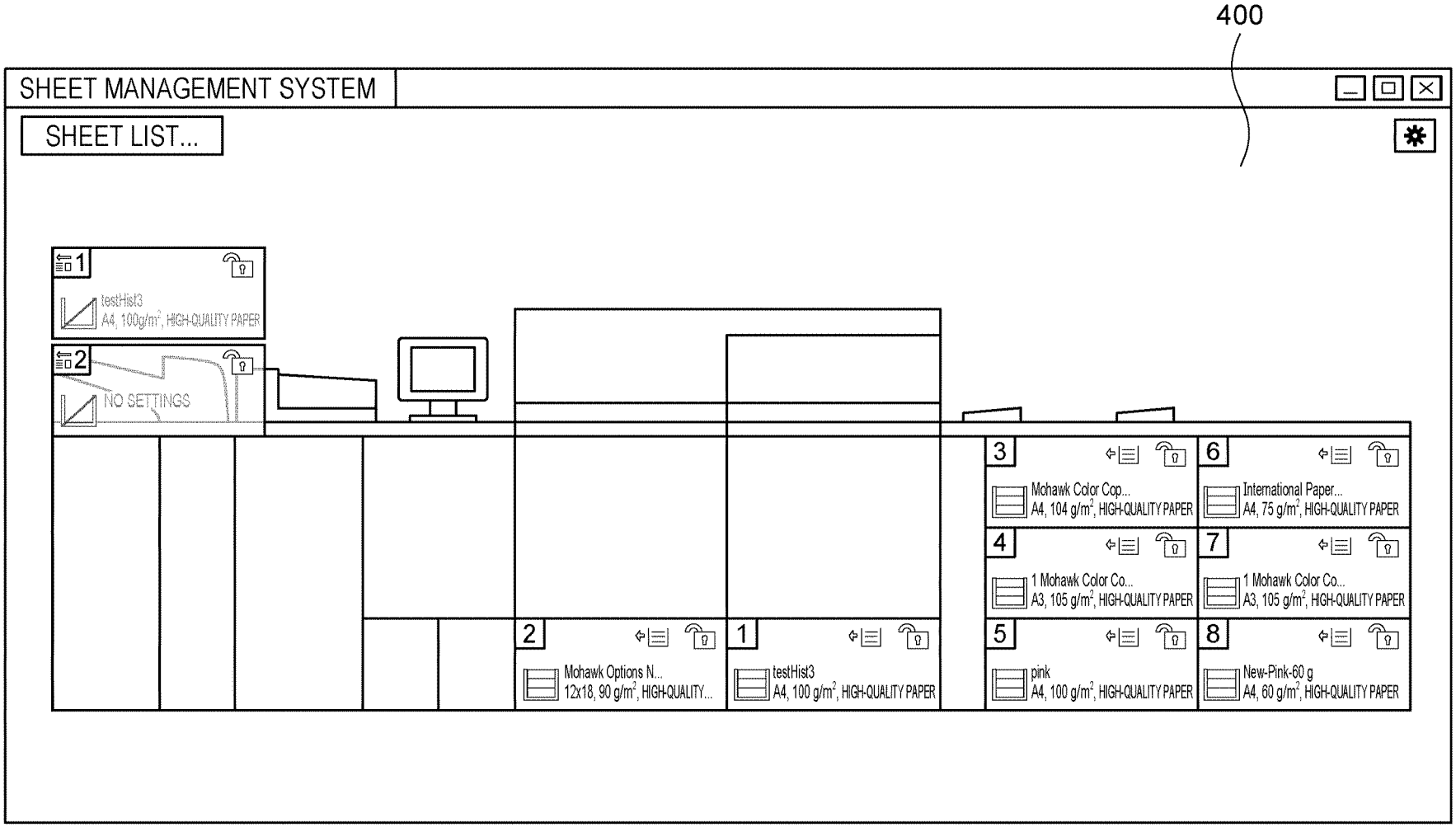
FIG. 12A is a diagram illustrating a top screen in the case where the sheet management application is executed on the print processing apparatus in a first embodiment.
Figure 12B:
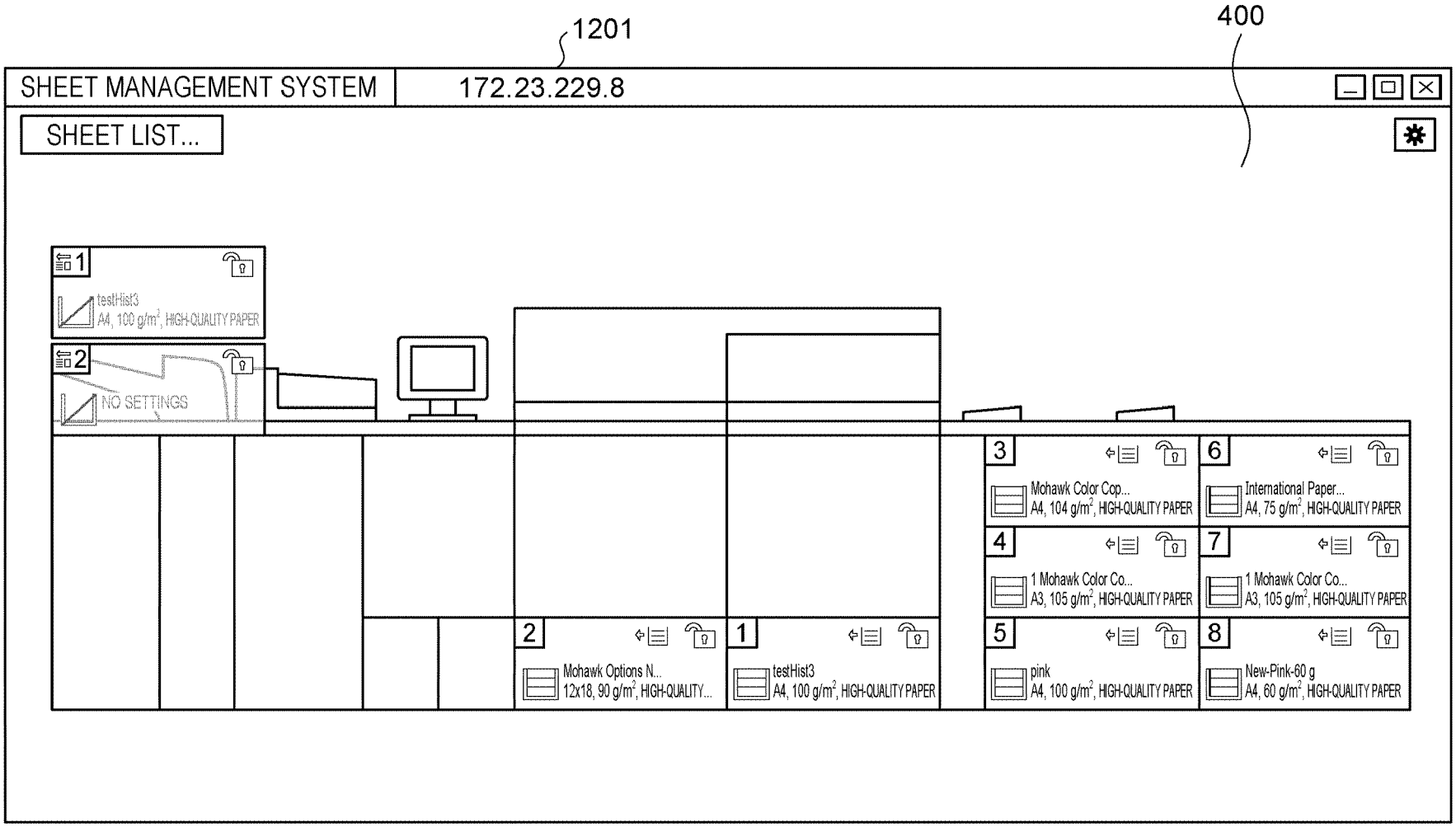
FIG. 12B is a diagram illustrating a top screen in the case where the sheet management application is executed on the information processing apparatus in the first embodiment.
Figure 15A:
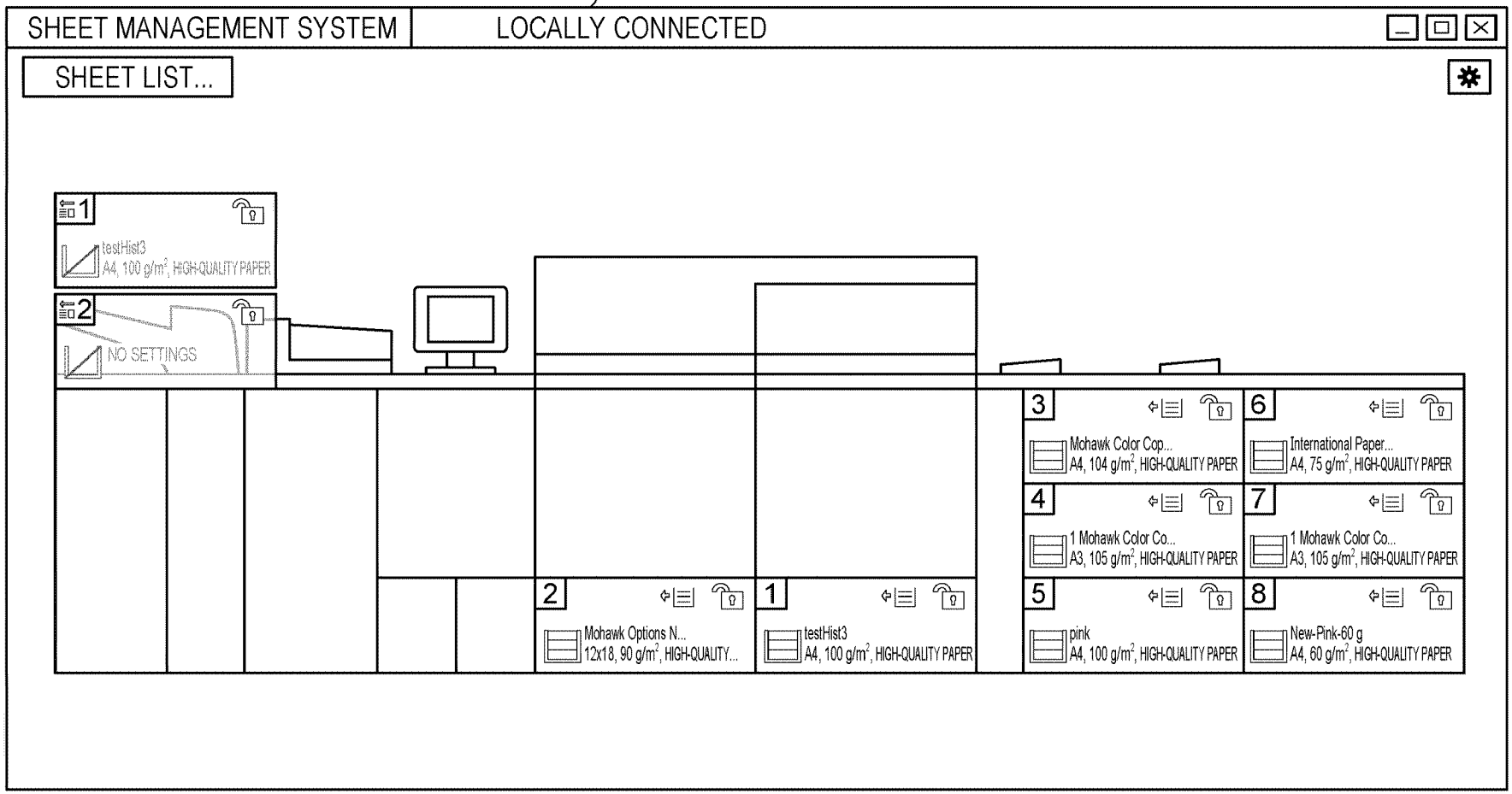
FIG. 15A is a diagram illustrating a top screen in the case where the sheet management application is executed on the print processing apparatus in a modification of the first embodiment.
Figure 15B:
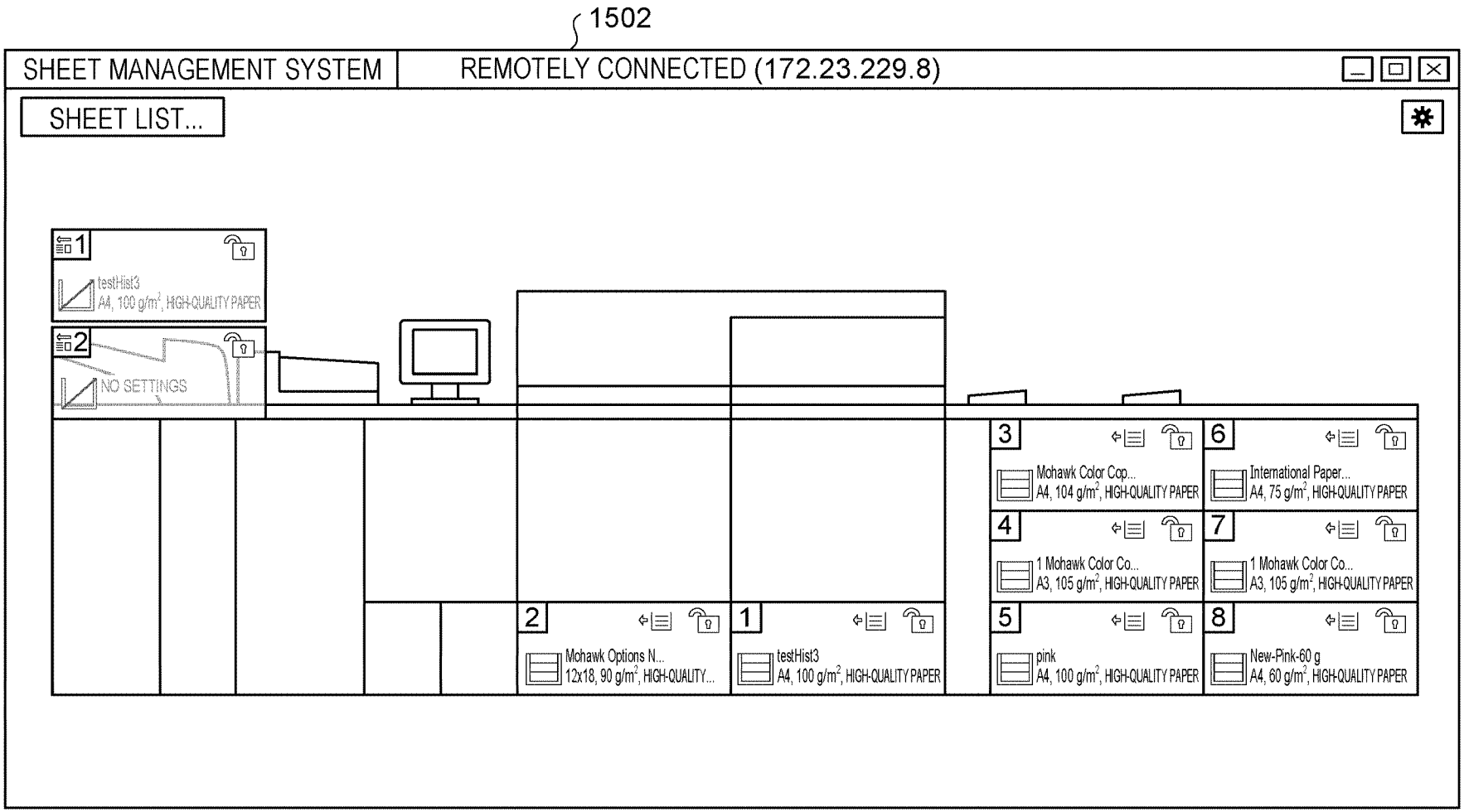
FIG. 15B is a diagram illustrating a top screen in the case where the sheet management application is executed on the information processing apparatus in the modification of the first embodiment.

In the present embodiment, whether the sheet management application is executed on the client computer 101 or the sheet management application is executed on the print processing apparatus 102 is distinctively displayed. Accordingly, the operator can determine whether an image forming apparatus near a terminal executing the sheet management application is highly likely to be an apparatus that serves as a target of sheet management. FIG. 12A is a diagram illustrating a top screen in the case where the sheet management application is executed on the print processing apparatus in the first embodiment. FIG. 12B is a diagram illustrating a top screen in the case where the sheet management application is executed on the information processing apparatus. FIG. 15A is a diagram illustrating a top screen in the case where the sheet management application is executed on the print processing apparatus in a modification of the first embodiment. FIG. 15B is a diagram illustrating a top screen in the case where the sheet management application is executed on the information processing apparatus in the modification of the first embodiment.

In the case of executing the sheet management application on the print processing apparatus 102, a screen such as that illustrated in FIG. 12A is displayed. In the case of executing the sheet management application on the print processing apparatus 102, the image forming apparatus 103 which is a target of sheet management is directly connected (locally connected). Therefore, unnecessary information is not displayed. Note that, as a modification, as illustrated in FIG. 15A, a message 1501 indicating that the image forming apparatus 103 is locally connected may be arranged on the top screen.

In the case of executing the sheet management application on the client computer 101, a screen such as that illustrated in FIG. 12B is displayed. In the case of executing the sheet management application the client computer 101, the image forming apparatus 103 which is a target of sheet management is connected via a network (remotely connected). Therefore, IP address information 1201 of the sheet management destination (here, the print processing apparatus 102 connected to the image forming apparatus 103) is arranged such that the user can determine which apparatus serves as a target of sheet management. Note that, as a modification, as illustrated in FIG. 15B, a message 1502 indicating that the image forming apparatus 103 is remotely connected may be arranged on the top screen.

Instead of the IP address information 1201, other address information such as a domain name, or other information for specifying the device, such as the name of the image forming apparatus, may be arranged.

Flow of Activation

Figure 9:
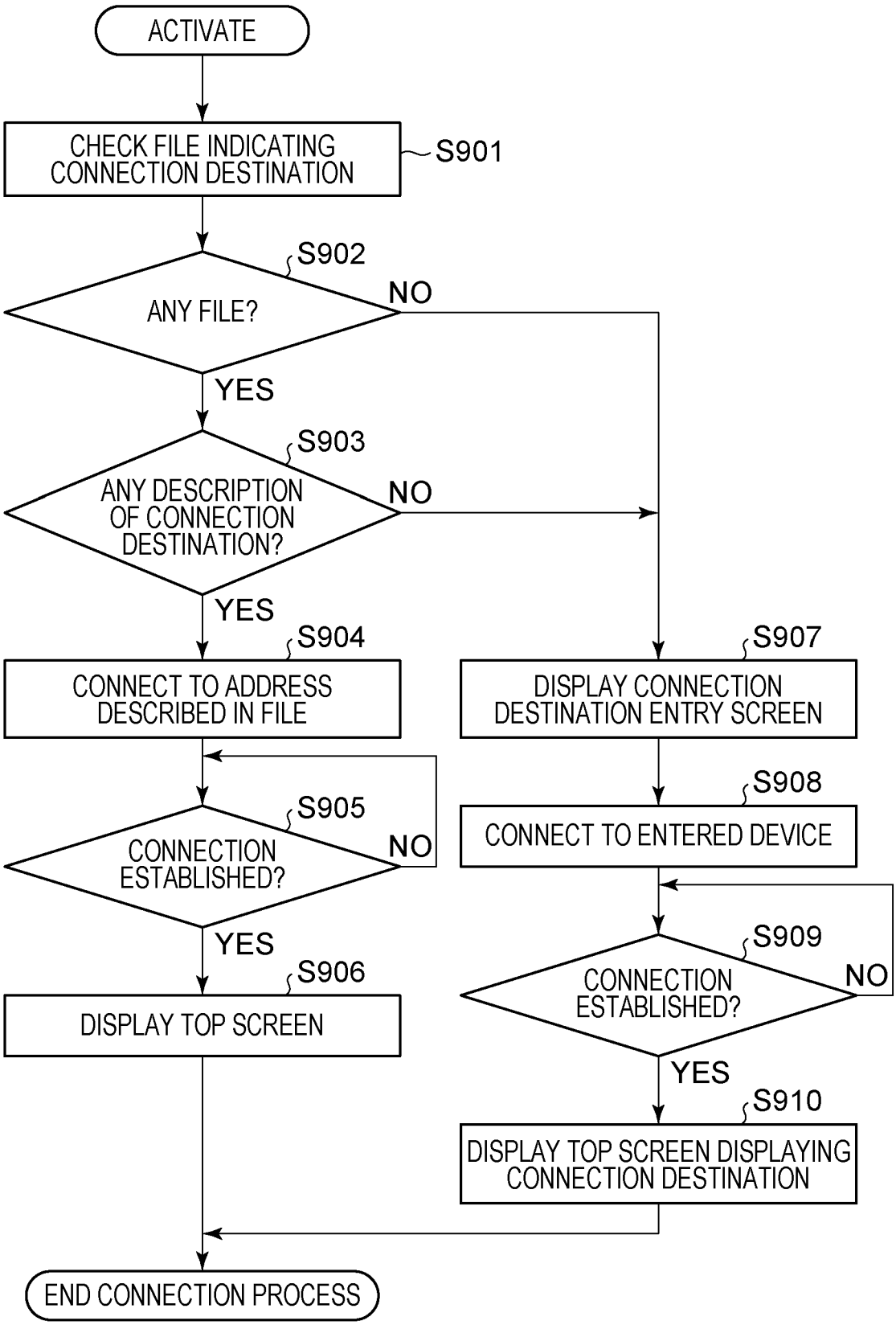
FIG. 9 is a flowchart illustrating a connection process.

The flow of a process in the case where the details described in the use case are realized by a common application by the client computer 101 and the print processing apparatus 102 will be described. FIG. 9 is a flowchart of a connection process.

A program for the print processing apparatus 102 according to the flowchart illustrated in FIG. 9 is stored in the external storage device 309 illustrated in FIG. 3, is read out to the RAM 302, and is executed by the CPU 301. A program for the client computer 101 according to the flowchart illustrated in FIG. 9 is stored in the external storage device 408 illustrated in FIG. 4, is read out to the RAM 402, and is executed by the CPU 401.

In response to detection of activation, the sheet management application performs a process of determining whether an apparatus where the application has been executed is a locally connected apparatus or a remotely connected apparatus. More specifically, in S901, the sheet management application checks whether or not the device information file 1004 is stored in a directory in the apparatus where the application is running. As for the checking method, checking is done using the absolute path of the folder 1002 where the server system is installed or a relative path for the sheet management application folder 1001. In the case where there is the device information file 1004 in a certain path (YES in S902), the sheet management application advances the process to S903; and, in the case where there is not the device information file 1004 in a certain path (NO in S902), the sheet management application advances the process to S907. Here, the fact that there is the device information file 1004 means that the sheet management application is running on the print processing apparatus 102. The fact that there is not the device information file 1004 means that the sheet management application is running on the client computer 101.

In S903, the sheet management application checks whether or not there is a description of the connection destination in the device information file 1004. In the case where there is a description of the connection destination (YES in S903), the sheet management application advances the process to S904; and, in the case where there is no description of the connection destination (NO in S903), the sheet management application advances the process to S907.

In S904, the sheet management application tries to connect to the connection destination obtained from the file 1004, and advances the process to S905.

In S905, the sheet management application retries to establish connection at regular intervals until connection is established. When connection is established in S905, the sheet management application advances the process to S906. In S906, the sheet management application displays a top screen for local connection (such as FIG. 12A).

In S907, the sheet management application displays the connection destination entry screen 1101, and advances the process to S908. When the connection destination is entered on the connection destination entry screen 1101 and the OK button 1103 is pressed, the sheet management application advances the process to S909. In S909, the sheet management application retries to establish connection at regular intervals until connection is established. When connection is established in S909, the sheet management application advances the process to S910.

In S910, the sheet management application displays a top screen for remote connection (such as FIG. 12B).

Remarks

As has been described above, in the present embodiment, in the case where the sheet management application is executed on the print processing apparatus 102, the top screen is displayed without requiring entry of address information. Alternatively, in the case where the sheet management application is executed on the client computer 101, the top screen is displayed based on entered address information. In this manner, the operability can be refined by making the operation different depending on the apparatus where the application has been activated.

In the present embodiment, information indicating whether the image forming apparatus 103 is being locally connected or remotely connected is displayed on the top screen of the sheet management application. This information is helpful for the user to determine which apparatus is the sheet management destination apparatus.

Second Embodiment

In the first embodiment, the top screen is displayed after the connection destination is confirmed. In contrast, in a second embodiment, a UI configured to execute displaying the top screen even when the connection destination is not confirmed, and the connection destination is changeable while the application is running is provided. In addition, in the present embodiment, the print processing apparatus 102 may connect to an image forming apparatus other than the image forming apparatus 103.

Top Screen

Figure 13A:
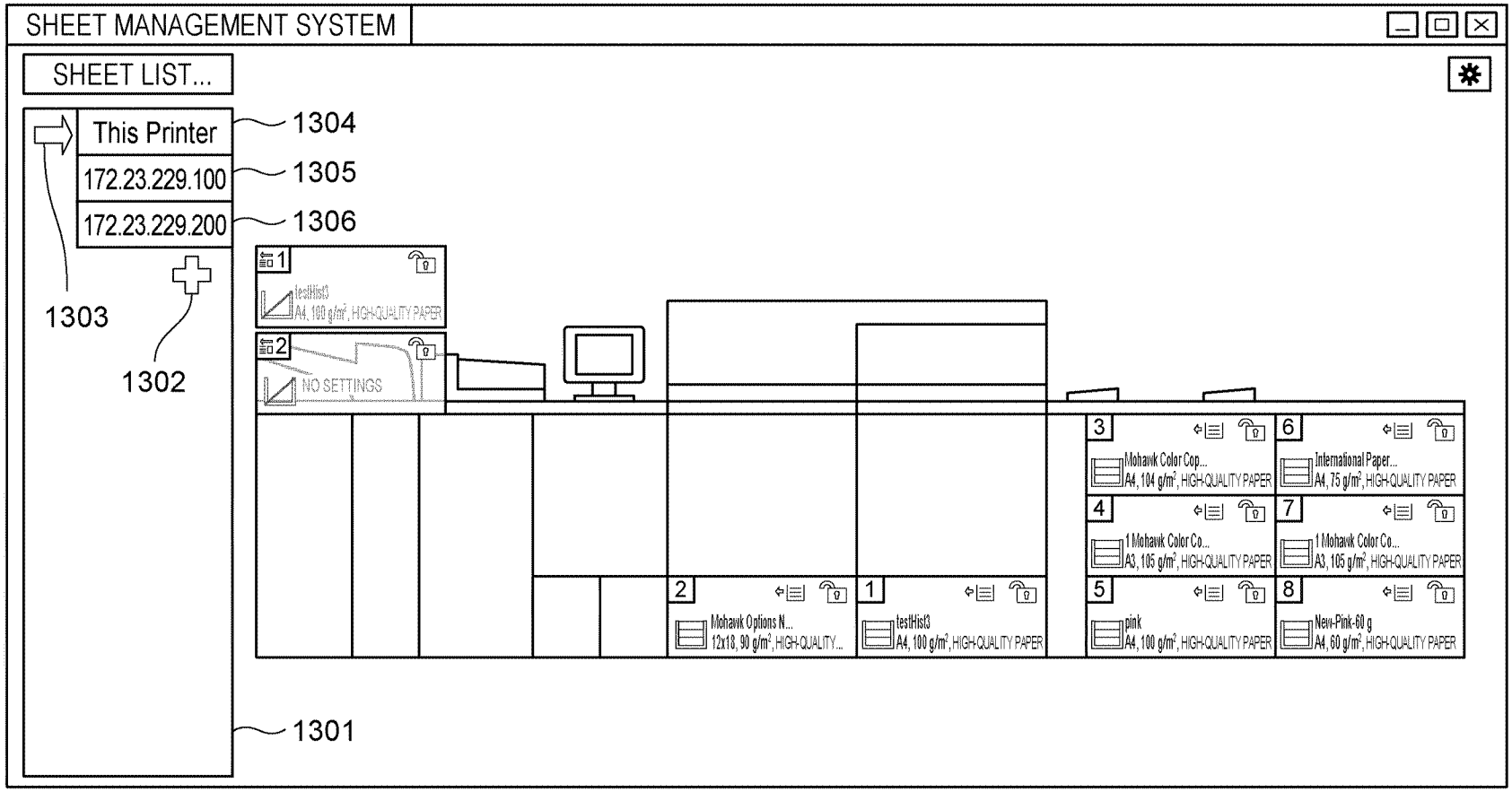
FIG. 13A is a diagram illustrating a top screen in the case where the sheet management application is executed on the print processing apparatus in a second embodiment.

An operation screen of the sheet management application in the second embodiment will be described. FIG. 13A is a diagram illustrating a top screen in the case where the sheet management application is executed on the print processing apparatus in the second embodiment. As illustrated in FIG. 13A, the top screen in the second embodiment includes a connection destination list display field 1301.

The connection destination list display field 1301 includes a new addition button 1302, a being-connected instruction icon 1303, connection destination information 1304, connection destination information 1305, and connection destination information 1306.

The new addition button 1302 is a button for starting a process of adding address information of an image forming apparatus to be registered as a sheet management destination (or a print processing apparatus directly connected to the image forming apparatus). In response to selection of the new addition button 1302, a screen such as that illustrated in FIG. 11 is displayed.

The being-connected instruction icon 1303 is an icon indicating which is apparatus information of an apparatus that is currently being connected and that is currently displaying sheet management information. In FIG. 13A, "This Printer" is specified as an apparatus that is currently being connected.

The connection destination information 1304, the connection destination information 1305, and the connection destination information 1306 indicate items of information on apparatuses that can be specified as a sheet management destination. In response to selection of a desired or predetermined connection destination from among these candidates for the connection destination, connection with the desired connection destination is started, and the device information is updated.

The connection destination information 1304 is represented with "This Printer", which indicates that there is a locally connectable image forming apparatus. Note that information on a locally connectable image forming apparatus is automatically added to the connection destination list display field 1301 upon activation of the sheet management application.

The connection destination information 1305 and the connection destination information 1306 are represented with IP addresses, which indicate that there are remotely connectable image forming apparatuses. Information on a remotely connectable image forming apparatus is added to the connection destination list display field 1301 when a remotely connectable image forming apparatus is added using the new addition button 1302 or when connection with a remotely connectable image forming apparatus has been established in the past. As for the connection destination added using the new addition button 1302, connection destination information is stored as a setting file in the management folder of the sheet management application.

Connection destination information on an image forming apparatus with which connection has been established in the past is stored as a setting file in the management folder of the sheet management application.

Figure 13B:
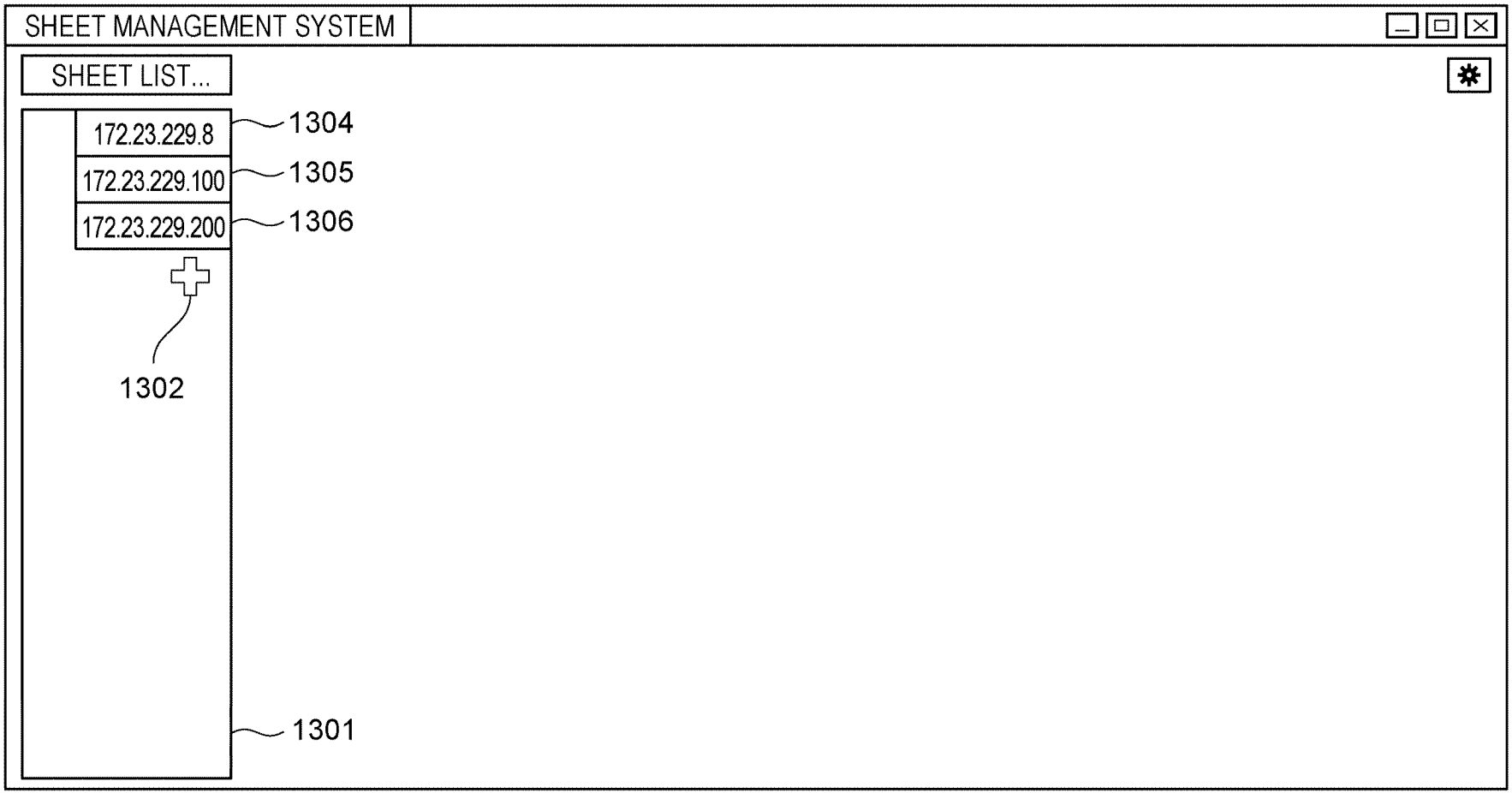
FIG. 13B is a diagram illustrating a top screen in the case where the sheet management application is executed on the information processing apparatus in the second embodiment.

FIG. 13B is a diagram illustrating a top screen in the case where the sheet management application is executed on an information processing apparatus in the second embodiment.

As illustrated in FIG. 13B, in response to activation of the sheet management application in a remote environment such as the client computer 101, no connection is established with an image forming apparatus, and no device information is displayed on the top screen. In order to start sheet management, a connection destination is specified from the connection destination list display field 1301. Since this is usage in a remote environment, the connection destination information 1304 for specifying the image forming apparatus 103 as a sheet management destination is not represented as "This Printer", but as "172.23.229.8".

Flow of Activation

Figure 14:
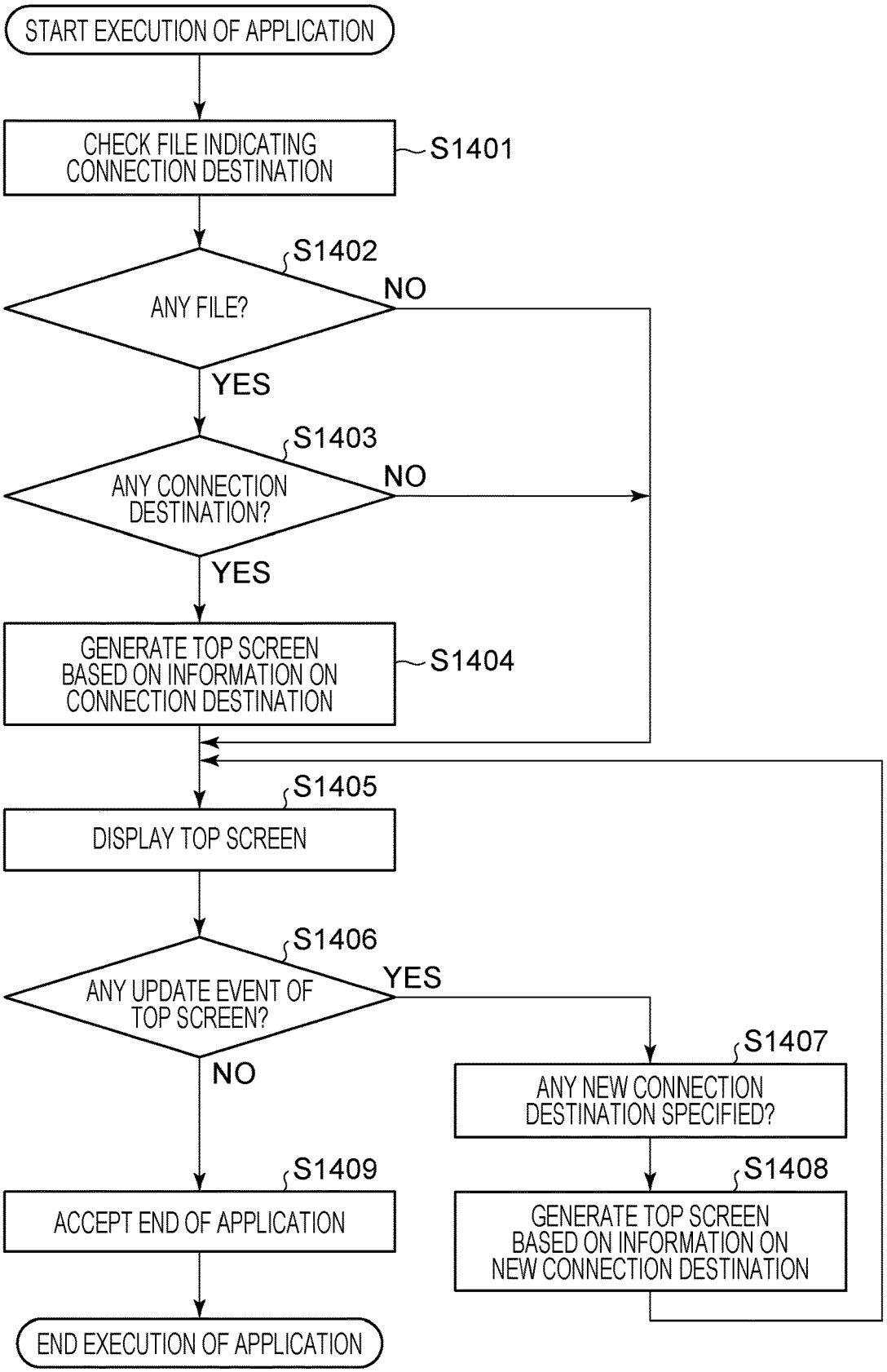
FIG. 14 is a flowchart illustrating a sheet management application activation process in the second embodiment.

The flow of activation in the second embodiment will be described. FIG. 14 is a flowchart of a sheet management application activation process in the second embodiment. A program for the print processing apparatus 102 according to the flowchart illustrated in FIG. 14 is stored in the external storage device 309 illustrated in FIG. 3, is read out to the RAM 302, and is executed by the CPU 301. A program for the client computer 101 according to the flowchart illustrated in FIG. 14 is stored in the external storage device 408 illustrated in FIG. 4, is read out to the RAM 402, and is executed by the CPU 401.

Upon detection of activation, the sheet management application performs a process of determining whether or not an apparatus where the sheet management application has been executed is a locally connected apparatus or a remotely connected apparatus. More specifically, in S1401, the sheet management application checks whether or not the device information file 1004 is stored in a directory of the apparatus where the sheet management application is running. As for the checking method, checking is done using the absolute path of the folder 1002 where the server system is installed or a relative path for the sheet management application folder 1001. In the case where there is the device information file 1004 in a certain path (YES in S1402), the sheet management application advances the process to S1403. In the case where there is not the device information file 1004 in a certain path (NO in S1402), the sheet management application advances the process to S1405. Here, the case in which there is the device information file 1004 means that the sheet management application is running on the print processing apparatus 102. The case in which there is not the device information file 1004 means that the sheet management application is running on the client computer 101.

In S1403, the sheet management application checks whether or not there is a description of the connection destination in the device information file 1004. In the case where there is a description of the connection destination (YES in S1403), the sheet management application advances the process to S1404: and, in the case where there is no description of the connection destination (NO in S1403), the sheet management application advances the process to S1405.

In S1404, the sheet management application connects to the connection destination obtained from the file 1004, obtains device information of the connection destination, and generates a top screen based on the information. Then, the sheet management application advances the process to S1405.

In S1405, the sheet management application displays the top screen of the application. If the top screen corresponding to the connection destination has been generated, a screen such as that illustrated in FIG. 13A is displayed, and if the connection destination has not been determined, a screen such as that illustrated in FIG. 13B is displayed.

In S1406, the sheet management application detects whether or not there is an update of the top screen. In the case where there is no update of the top screen (NO in S1406) and the user gives an instruction to end the application (S1409), the sheet management application ends the process.

In the case where there is an update of the top screen (YES in S1406) and upon detection that the update is caused by specification of a new connection destination (S1407), the sheet management application advances the process to S1408. The new connection destination is specified by selecting connection destination information in the connection destination list display field 1301 or by selecting the new addition button 1302 and entering the connection destination on the connection destination entry screen illustrated in FIG. 11.

In S1408, the sheet management application connects to the specified connection destination, obtains device information of the connection destination, and generates a top screen based on the information. Then, the sheet management application returns the process to S1405. With the above-described flow, the sheet management destination can be switched even while the application is running.

Remarks

As described above, in the present embodiment, the sheet management destination can be switched while the sheet management application is running. This saves the operator time and effort to restart the application, which provides excellent operability.

In the present embodiment, connection destination information is registered in advance, and a sheet management destination is switchable by selecting that information. This saves the operator time and effort to enter address information each time the operator establishes connection, which provides excellent operability.

Other Embodiments

The present disclosure can be realized by supplying a program that realizes one or more functions of the above-described embodiments to a system or an apparatus via a network or a storage medium, and reading and executing the program by one or more processors included in a computer of the system or the apparatus. Alternatively, the present disclosure can be realized by a circuit (such as an application-specific integrated circuit (ASIC)) that realizes one or more functions.

In addition, the present disclosure is applicable to a system including a plurality of devices or an apparatus including a single device. For example, some of modules described in the software may be configured to be executed by an external server, and the function(s) may be realized by obtaining the result of processing performed by the external server. For example, a job storage unit that stores print data may be provided in an external server.

The present disclosure is not limited to the above-described embodiments. Various modifications (including organic combinations of the embodiments) can be made based on the spirit of the present disclosure, and these modifications are not excluded from the scope of the present disclosure. That is, configurations obtained by combining the above-described embodiments and their modifications are all included in the present disclosure.

Note that the definition of abbreviations appearing in the embodiments is as follows. ASIC stands for application specific integrated circuit. CPU stands for central processing unit. FAX stands for facsimile. LAN stands for local area network. MFP stands for multi-function peripheral. PC stands for personal computer. PDL stands for page description language. RAM stands for random-access memory. ROM stands for read-only memory. SFP stands for single function peripheral. UI stands for user interface. USB stands for Universal Serial Bus. IF stands for interface.

Embodiments of the present disclosure can also be realized by a computer of a system or apparatus that reads out and executes computer executable instructions recorded on a storage medium (e.g., non-transitory computer-readable storage medium) to perform the functions of one or more of the above-described embodiment(s) of the present disclosure, and by a method performed by the computer of the system or apparatus by, for example, reading out and executing the computer executable instructions from the storage medium to perform the functions of one or more of the above-described embodiment(s). The computer may include one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-140394, filed Jul. 26, 2018, which is hereby incorporated by reference herein in its entirety.

What is claimed is:

1. A non-transitory computer-readable storage medium storing a program to cause a computer to perform a method for an information processing apparatus, the method comprising:

determining, at predetermined timing, whether address information of a printing apparatus is stored in the information processing apparatus;

causing a display of the information processing apparatus to display an address information reception screen for receiving address information in a case where it is determined that the address information of the printing apparatus is not stored in the information processing apparatus;

causing the information processing apparatus to transmit a first request to a transfer port of a print processing apparatus based on the received address information, wherein the first request is transferred to the printing apparatus by the print processing apparatus;

causing the information processing apparatus to receive configuration information of the printing apparatus, wherein the configuration information is transmitted via the print processing apparatus from the printing apparatus as a response to the transmitted first request;

causing, in a case where it is determined that the address information of the printing apparatus is stored in the information processing apparatus, the information processing apparatus to transmit a second request to the printing apparatus based on the stored address information; and causing the information processing apparatus to receive the configuration information of the printing apparatus, wherein the configuration information is transmitted from the printing apparatus as a response to the transmitted second request.

2. The non-transitory computer-readable storage medium according to claim 1, wherein, in a case where it is determined that the address information of the printing apparatus is stored in the information processing apparatus, the second request is transmitted to the printing apparatus based on the stored address information without causing the display of the information processing apparatus to display the address information reception screen.

3. The non-transitory computer-readable storage medium according to claim 1, wherein the predetermined timing is timing of start of the program to cause the computer to perform the method.

4. The non-transitory computer-readable storage medium according to claim 1, wherein determining whether the address information of the printing apparatus is stored includes determining whether the address information of the printing apparatus is stored in a predetermined location of the information processing apparatus.

5. The non-transitory computer-readable storage medium according to claim 1, wherein the configuration information includes information of sheets stored in a sheet holding unit of the printing apparatus.

6. The non-transitory computer-readable storage medium according to claim 5, wherein the information of the sheets includes a name of a sheet.

7. The non-transitory computer-readable storage medium according to claim 5, wherein the information of the sheets further includes a basic weight of a sheet, a color of a sheet, or a surface property of a sheet.

8. The non-transitory computer-readable storage medium according to claim 1, the method further comprising setting information of sheets stored in a sheet holding unit of the printing apparatus.

9. The non-transitory computer-readable storage medium according to claim 8, wherein the information of the sheets in the configuration information includes a name of a sheet.

10. The non-transitory computer-readable storage medium according to claim 8, wherein the information of the sheets in the configuration information further includes a basic weight of a sheet, a color of a sheet, or a surface property of a sheet.

11. A control method for controlling an information processing apparatus, the control method comprising:

determining, at predetermined timing, whether address information of a printing apparatus is stored in the information processing apparatus;

causing a display of the information processing apparatus to display an address information reception screen for receiving address information in a case where it is determined that the address information of the printing apparatus is not stored in the information processing apparatus;

transmitting a first request to a transfer port of a print processing apparatus based on the received address information, wherein the first request is transferred to the printing apparatus by the print processing apparatus;

receiving configuration information of the printing apparatus, wherein the configuration information is transmitted via the print processing apparatus from the printing apparatus as a response to the transmitted first request;

transmitting, in a case where it is determined that the address information of the printing apparatus is stored in the information processing apparatus, a second request to the printing apparatus based on the stored address information; and receiving the configuration information of the printing apparatus, wherein the configuration information is transmitted from the printing apparatus as a response to the transmitted second request.

12. A non-transitory computer-readable storage medium storing a program to cause a computer to perform a method for an information processing apparatus, the method comprising:

determining, at predetermined timing, whether address information of a printing apparatus is stored in the information processing apparatus;

causing a display of the information processing apparatus to display an address information reception screen for receiving address information in a case where it is determined that the address information of the printing apparatus is not stored in the information processing apparatus;

causing the information processing apparatus to transmit a first request based on the received address information;

causing the information processing apparatus to receive configuration information of the printing apparatus transmitted from the printing apparatus as a response to the transmitted first request;

causing, in a case where it is determined that the address information of the printing apparatus is stored in the information processing apparatus, the information processing apparatus to transmit a second request to the printing apparatus based on the stored address information; and causing the information processing apparatus to receive the configuration information of the printing apparatus, wherein the configuration information is transmitted from the printing apparatus as a response to the transmitted second request.

13. The non-transitory computer-readable storage medium according to claim 12, wherein, in a case where it is determined that the address information of the printing apparatus is stored in the information processing apparatus, the second request is transmitted to the printing apparatus based on the stored address information without causing the display of the information processing apparatus to display the address information reception screen.

14. The non-transitory computer-readable storage medium according to claim 12, wherein the predetermined timing is timing of start of the program to cause the computer to perform the method.

15. The non-transitory computer-readable storage medium according to claim 12, wherein determining whether the address information of the printing apparatus is stored includes determining whether the address information of the printing apparatus is stored in a predetermined location of the information processing apparatus.

16. The non-transitory computer-readable storage medium according to claim 12, wherein the configuration information includes information of sheets stored in a sheet holding unit of the printing apparatus.

17. The non-transitory computer-readable storage medium according to claim 16, wherein the information of the sheets includes a name of a sheet.

18. The non-transitory computer-readable storage medium according to claim 16, wherein the information of the sheets further includes a basic weight of a sheet, a color of a sheet, or a surface property of a sheet.

19. The non-transitory computer-readable storage medium according to claim 12, the method further comprising setting information of sheets stored in a sheet holding unit of the printing apparatus.

20. The non-transitory computer-readable storage medium according to claim 19, wherein the information of the sheets in the configuration information includes a name of a sheet.

21. The non-transitory computer-readable storage medium according to claim 19, wherein the information of the sheets in the configuration information further includes a basic weight of a sheet, a color of a sheet, or a surface property of a sheet.

* * * * *